US005415991A

United States Patent [19]

Kase et al.

[11] Patent Number: 5,415,991

[45] Date of Patent: May 16, 1995

[54] STABLE, RAPIDLY-DEVELOPABLE SILVER HALIDE PHOTOGRAPHIC MATERIAL

[75] Inventors: Akira Kase; Naoto Ohshima; Nobutaka Ohki, all of Kanagawa, Japan

[73] Assignee: Fuji Photo Film Co., Ltd., Kanagawa, Japan

[21] Appl. No.: 150,287

[22] Filed: Nov. 10, 1993

Related U.S. Application Data

[63] Continuation of Ser. No. 875,829, Apr. 30, 1992, abandoned.

[30] Foreign Application Priority Data

May 10, 1991 [JP] Japan ..... 3-133251
May 10, 1991 [JP] Japan ..... 3-133349

[51] Int. Cl.[6] ..... G03C 1/34; G03C 1/42; G03C 1/09

[52] U.S. Cl. ..... 430/600; 430/551; 430/566; 430/607; 430/608; 430/603; 430/604; 430/605; 430/567

[58] Field of Search ..... 430/551, 567, 600, 603, 430/604, 605, 607, 608, 553, 264, 440, 483, 566

[56] References Cited

U.S. PATENT DOCUMENTS

| | | | |
|---|---|---|---|
| 3,265,499 | 8/1966 | Willems et al. | 430/566 |
| 3,297,446 | 1/1967 | Dunn | 430/550 |
| 3,420,670 | 1/1969 | Milton | 96/609 |
| 4,128,425 | 12/1978 | Greenwald | 430/440 |
| 4,175,968 | 11/1979 | Credner et al. | 430/566 |
| 4,264,721 | 4/1981 | Shimano et al. | 430/551 |
| 4,473,635 | 9/1984 | Ishikawa et al. | 430/566 |
| 4,865,947 | 9/1989 | Kuwabara et al. | 430/603 |
| 4,912,026 | 3/1990 | Miyoshi et al. | 430/607 |
| 4,978,606 | 12/1990 | Ohbi et al. | 430/566 |
| 5,001,041 | 3/1991 | Kishimoto et al. | 430/567 |
| 5,051,342 | 9/1991 | Shiba et al. | 430/607 |
| 5,061,594 | 10/1991 | Okamura et al. | 430/264 |
| 5,108,877 | 4/1992 | Asami | 430/567 |
| 5,158,892 | 10/1992 | Sasaki et al. | 430/605 |

FOREIGN PATENT DOCUMENTS

| | | | |
|---|---|---|---|
| 0255983 | 2/1988 | European Pat. Off. . | |
| 0335107 | 10/1989 | European Pat. Off. . | |
| 0488029 | 6/1992 | European Pat. Off. . | |
| 59-204039 | 11/1984 | Japan | 430/607 |
| 59-222836 | 12/1984 | Japan | 430/607 |
| 26943 | 1/1990 | Japan . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A silver halide photographic material comprises at least one light-sensitive emulsion layer containing a silver halide emulsion on a support. The light-sensitive emulsion layer comprises (a) a silver halide emulsion containing silver halide grains having a silver chloride content of 90 mol % or more, in some cases 95 mol % or more, and (b) at least one compound represented by formula (I), (II) or (III):

(I)

(II)

$$R^{31}-(Y^3)_n-\underset{\underset{R^{34}}{|}}{N}-X^3$$

(III)

in which the variables are as defined in the specification.

In some embodiments of the invention, the silver halide emulsion (a) may be sensitized with a selenium, gold or iridium compound. Also, in some embodiments of the invention, the silver halide grains are substantially iodide-free and have a localized phase with a silver bromide content of 10% or more in the vicinity of the grain surface.

11 Claims, No Drawings

STABLE, RAPIDLY-DEVELOPABLE SILVER HALIDE PHOTOGRAPHIC MATERIAL

This is a Continuation of application Ser. No. 07/875,829 filed Apr. 30, 1992 now abandoned.

FIELD OF THE INVENTION

The present invention relates to a silver halide photographic material. More particularly, the present invention relates to a silver halide photographic material which can undergo rapid processing and exhibits high sensitivity, reduced sensitivity change due to humidity fluctuations upon exposure, reduced fog density rise even after prolonged storage thereof, reduced sensitivity and gradation change due to fluctuations in exposure time, and reduced sensitivity and gradation fluctuations due to change in the time required between exposure and processing.

BACKGROUND OF THE INVENTION

There is a great diversity of commercially available silver halide photographic materials and image formation methods using these silver halide photographic materials. These silver halide photographic materials and image formation methods have been used in various fields. The halogen composition of the silver halide emulsion incorporated in these light-sensitive materials, particularly if they are for picture taking, is preferably silver bromoiodide mainly comprising silver bromide for the purpose of attaining high sensitivity.

On the other hand, products for use in a market requiring the completion of a large number of prints in a short delivery period, such as light-sensitive material for color photographic use, comprise silver bromide or silver bromochloride substantially free of silver iodide in view of the necessity for expedited development.

In recent years, the demand for improvement in the capability of color photographic papers to undergo rapid processing has grown more and more. It is known that the rise in the silver chloride content of the silver halide emulsion to be used brings about a great rise in development speed. Silver chloride emulsions are known to be disadvantageous in that they generally exhibit a low sensitivity. In order to overcome this difficulty, various techniques have been disclosed for increasing the sensitivity of a silver halide emulsion having a high silver chloride content.

It is also known that such a silver halide emulsion having a high silver chloride content can hardly provide a high sensitivity and a high gradation in an ordinary chemical sensitization process. Additionally, it exhibits a great reciprocity law failure, i.e., a great sensitivity and gradation change due to a change in exposure illuminance. Various techniques have been disclosed to overcome these difficulties.

Selenium sensitization and gold sensitization are known as techniques for increasing the sensitivity of a silver halide emulsion. When the inventors applied selenium sensitization or gold sensitization to a silver halide emulsion having a high silver chloride content, they confirmed its sensitizing effect.

Light-sensitive materials for color photographic paper are required to exhibit little change in their photographic properties even after prolonged storage thereof. However, it was found that light-sensitive materials comprising a selenium-sensitized or gold-sensitized high silver chloride content emulsion which can undergo rapid processing tend to show disadvantageously a rise in fog density after prolonged storage thereof.

Further, color photographic papers preferably exhibit no change in photographic properties due to the humidity fluctuations upon printing in photofinishing laboratories. This is very important for the maintenance of constant quality. Light-sensitive materials comprising a selenium-sensitized high silver chloride content emulsion need to undergo moderate selenium sensitization to reduce the rise in fog density due to prolonged storage thereof. However, it was found that if such a silver chloride content emulsion undergoes moderate selenium sensitization, it disadvantageously exhibits a great sensitivity change due to the humidity fluctuations upon exposure. It was further found that this is also the case with gold sensitization.

JP-A-58-95736, JP-A-58-108533, JP-A-60-222844, JP-A-60-222845 and JP-A-64-26837 disclose that a high sensitivity and a high gradation can be accomplished with a high silver chloride content emulsion having differently structured silver bromide-filled regions. These techniques surely can provide a high sensitivity emulsion, but have only a small effect in correcting reciprocity law failure.

It is known that the reciprocity law failure of a silver halide emulsion can be effectively corrected by doping silver halide grains with iridium. For example, JP-B-43-4935 (the term "JP-B" as used herein means an "examined Japanese patent publication") discloses that light-sensitive materials comprising a silver halide emulsion containing a slight amount of an iridium compound which has been added during precipitation or ripening thereof can provide an image having an almost constant gradation over a wide range of exposure times. However, it is disclosed in *Journal of Photographic Science*, vol. 33, page 201 (1985), that a high silver chloride content emulsion doped with iridium shows latent image intensification between 15 seconds and about 2 hours after exposure. This phenomenon causes fluctuations in sensitivity and gradation due to the change in the time required between exposure and processing. Thus, this system is not practical.

JP-A-1-105940 discloses that a high silver chloride content emulsion selectively doped with iridium having silver bromide-filled regions can provide an emulsion having excellent reciprocity law adherence without impairing the latent image stability for several hours after exposure. However, the present inventors found that this technique can cause latent image sensitization under some reaction conditions for the formation of silver bromide-filled regions and that further improvements are needed to satisfy sufficiently latent image stability and reciprocity law at the same time. Furthermore, a high silver chloride content emulsion having a high silver bromide content localized phase was found to be disadvantageous in that it exhibits a great sensitivity change due to the fluctuations of humidity upon exposure and the fluctuations of the time interval between exposure and processing and also exhibits a great sensitivity change after prolonged storage of the light-sensitive material.

For example, light-sensitive materials for color photographic paper are required to exhibit little change in photographic properties even after prolonged storage thereof. It is also desired that these light-sensitive materials should have no change in the photographic properties against the fluctuations of humidity or the fluctuations of time interval between exposure and processing when subjected to printing in laboratories. These requirements are important in offering invariable quality color prints to users. Therefore, there has been a need to overcome the above mentioned disadvantages of high silver chloride content emulsions having a high silver bromide content localized phase.

The inventors found that these problems can be solved by incorporating a certain reducer in such a high silver chloride content emulsion. Thus, the present invention was worked out. On the other hand, JP-A-2-6943 (the term "JP-A" as used herein means an "unexamined published Japanese patent application") discloses that the preservability and latent image stability of a silver halide photographic material comprising a high silver chloride content emulsion can be improved by incorporating a reducing compound in the silver halide photographic material.

However, the above cited patent application does not disclose that the sensitivity change due to the fluctuations of humidity upon exposure can be remarkably inhibited when such a high silver chloride content emulsion is used in combination with a substantially silver iodide-free silver bromochloride emulsion having a localized phase with a silver bromide content of 10% or more in the vicinity of the surface of silver halide grains and having a silver chloride content of 95 mol % or more as in the present invention. The above cited patent application also does not disclose that this effect becomes remarkable particularly when this system is combined with a silver bromochloride emulsion containing an iridium compound.

SUMMARY OF THE INVENTION

It is therefore a first object of the present invention to provide a silver halide photographic material which can undergo rapid processing and which exhibits a high sensitivity, reduced sensitivity change due to the fluctuations of humidity upon exposure, and a reduced rise in the fog density even after prolonged storage thereof.

It is a second object of the present invention to provide a silver halide photographic material which can undergo rapid processing and exhibits reduced sensitivity and gradation fluctuations due to change in exposure time and reduced sensitivity and gradation fluctuations due to change in the time required between exposure and processing (i.e., improved latent image stability).

It is a third object of the present invention to provide a silver halide photographic material which can undergo rapid processing and which exhibits a high sensitivity, a reduced sensitivity change due to fluctuations of humidity upon exposure and fluctuations in the time interval between exposure and processing, and a reduced sensitivity change even after prolonged storage thereof.

These and other objects of the present invention will become more apparent from the following detailed description and examples.

The first object of the present invention is accomplished with a silver halide photographic material comprising at least one light-sensitive emulsion layer containing a silver halide emulsion on a support. The light-sensitive emulsion layer comprises (a) a silver halide emulsion chemically sensitized with a selenium compound or gold compound and containing silver halide grains having a silver chloride content of 90 mol % or more and (b) at least one of compound represented by the following formula (I), (II) or (III):

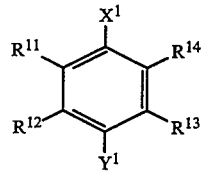

(I)

wherein $X^1$ represents $-NR^{15}R^{16}$ or $-NHSO_2R^{17}$; $Y^1$ represents a hydroxyl group or has the same meaning as $X^1$; $R^{11}$, $R^{12}$, $R^{13}$ and $R^{14}$ each represents a hydrogen atom or any substituent; $R^{11}$ and $R^{12}$, and $R^{13}$ and $R^{14}$ may together form a carbon ring; $R^{15}$ and $R^{16}$ each represents a hydrogen atom, an alkyl, aryl or heterocyclic group; $R^{15}$ and $R^{16}$ may together form a nitrogen-containing heterocyclic group; and $R^{17}$ represents an alkyl, aryl, amino or heterocyclic group;

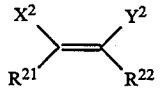

(II)

wherein $X^2$ and $Y^2$ each represents a hydroxyl group, $-NR^{23}R^{24}$ or $-NHSO_2R^{25}$; $R^{21}$ and $R^{22}$ each represents a hydrogen atom or any substituent; $R^{21}$ and $R^{22}$may together form a carbon ring or heterocyclic group; $R^{23}$ and $R^{24}$ each represents a hydrogen atom, an alkyl, aryl or heterocyclic group; $R^{23}$ and $R^{24}$ may together form a nitrogen-containing heterocyclic group; and $R^{25}$ represents an alkyl, aryl, amino or heterocyclic group;

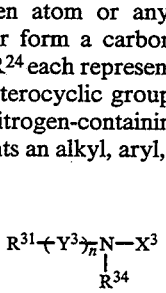

(III)

wherein $X^3$ represents a hydroxyl group or $-NR^{32}R^{33}$; $Y^3$ represents —CO— or $-SO_2-$; $R^{31}$ represents a hydrogen atom or any substituent; $R^{34}$ represents a hydrogen atom or an alkyl group; n represents an integer 0 or 1; $R^{32}$ and $R^{33}$ each represents a hydrogen atom, an alkyl, aryl or heterocyclic group; and $R^{31}$ and $R^{34}$, $R^{31}$ and $R^{32}$, and $R^{32}$ and $R^{33}$ may together form a nitrogen-containing heterocyclic group.

The second object of the present invention is accomplished with a silver halide photographic material comprising at least one light-sensitive emulsion layer containing a silver halide emulsion on a support. The silver halide emulsion layer comprises in at least one layer a silver halide emulsion made of silver bromochloride grains having a silver chloride content of 80 mol % or more, said silver bromochloride grains having a localized phase with a silver bromide content of 10% or more. The silver bromochloride grains have been selenium-sensitized.

The third object of the present invention is accomplished with a silver halide photographic material comprising at least one light-sensitive emulsion layer containing a silver halide emulsion on a support. The light-sensitive emulsion layer comprises (a) a substantially silver iodide-free silver bromochloride emulsion having a localized phase with a silver bromide content of 10% or more in the vicinity of the surface of the silver halide grains, the silver chloride content of all said grains being 95 mol % or more and (b) at least one of compound represented by the foregoing formula (I), (II) or (III).

DETAILED DESCRIPTION OF THE INVENTION

The present invention will be further described hereinafter.

In order to incorporate the compound represented by formula (I), (II) or (III) into the silver halide emulsion layer, it may be directly dispersed in the emulsion or it may be added to the emulsion in the form of a solution in a solvent such as water or methanol or mixture thereof. The time at which the compound is added to the emulsion may be in any step between the preparation of the emulsion and shortly before the coating of the emulsion and is preferably during the preparation of the coating solution. The amount of the compound represented by formula (I), (II) or (III) to be added is preferably in the range of $1\times10^{-5}$ to 1 mol, more preferably $1\times10^{-3}$ to $5\times10^{-1}$ mol, per mol of silver halide.

Among the compounds represented by formula (I), (II) or (III), the compounds represented by formula (III) provided $R^{34}$ represents a hydrogen atom and formula (II) provided $R^{21}$ and $R^{22}$ together form a heterocyclic ring exhibits the greatest effect in inhibiting the sensitivity change due to fluctuations of humidity upon exposure and the rise in the fog density after prolonged storage of the light-sensitive material. Therefore, the silver halide emulsion of the present invention most preferably contains at least one compound represented by formula (III) provided $R^{34}$ represents a hydrogen atom and formula (II) provided $R^{21}$ and $R^{22}$ together form a heterocyclic ring.

Formula (I) is further described below. In formula (I), $X^1$ represents $—NR^{15}R^{16}$ or $—NHSO_2R^{17}$. $Y^1$ represents a hydroxyl group or has the same meaning as $X^1$. $R^{11}$, $R^{12}$, $R^{13}$ and $R^{14}$ each represents a hydrogen atom or any substituent. Examples of such a substituent include an alkyl group (preferably $C_{1-20}$ alkyl group, e.g., methyl, ethyl, octyl, hexadecyl, t-butyl), an aryl group (preferably $C_{6-20}$ aryl group, e.g., phenyl, p-tolyl), an amino group (preferably $C_{0-20}$ amino group, e.g., amino diethylamino, diphenylamino, hexadecylamino), an amido group (preferably $C_{1-20}$ amide group, e.g., acetylamino, benzanoylamino, octadecanoylamino, benzenesulfonamide), an alkoxy group ($C_{1-20}$ alkoxy group, e.g., methoxy, ethoxy, hexadecyloxy), an alkylthio group (preferably $C_{1-20}$ alkylthio group, e.g., methylthio, butylthio, octadecylthio), an acyl group (preferably $C_{1-20}$ acyl group, e.g., acetyl, hexadecanoyl, benzoyl, benzenesulfonyl), a carbamoyl group (preferably $C_{1-20}$ carbamoyl group, e.g., carbamoyl, N-hexylcarbamoyl, N,N-diphenyicarbamoyl), an alkoxycarbonyl group (preferably $C_{2-20}$ alkoxycarbonyl group, e.g., methoxycarbonyl, octyloxycarbonyl), a hydroxyl group, a halogen atom (e.g., F, Cl, Br), a cyano group, a nitro group, a sulfo group, and a carboxyl group. These substituents may be further substituted by other substituents (e.g., those described as $R^{11}$ to $R^{14}$). $R^{11}$ and $R^{12}$, and $R^{13}$ and $R^{14}$ may together form a carbon ring (preferably a 5- to 7-membered ring). $R^{15}$ and $R^{16}$ each represents a hydrogen atom, an alkyl group (preferably $C_{1-10}$ alkyl group, e.g., ethyl, hydroxyethyl, octyl), an aryl group (preferably $C_{6-10}$ aryl group, e.g., phenyl, naphthyl) or a heterocyclic group (preferably $C_{2-10}$ heterocyclic group, e.g., 2-furanyl, 4-pyridyl) which may be further substituted by other substituents (e.g., those described as $R^{11}$ to $R^{14}$). $R^{15}$ and $R^{16}$ may together form a nitrogen-containing heterocyclic group (preferably a 5- to 7-membered ring). $R^{17}$ represents an alkyl group (preferably $C_{1-20}$ alkyl group, e.g., ethyl, octyl, hexadecyl), an aryl group (preferably $C_{6-20}$ aryl group, e.g., phenyl, p-tolyl, 4-dodecyloxyphenyl), an amino group (preferably $C_{0-20}$ amino group, e.g., N,N-diethylamino, N,N-diphenylamino, morpholino) or a heterocyclic group (preferably $C_{2-20}$ heterocyclic group, e.g., 3-pyridyl) which may be further substituted by other substituents.

in formula (I), $X^1$ preferably represents $—NHSO_2R^{17}$. and $Y^1$ preferably represents a hydroxyl group. $R^{11}$, $R^{12}$, $R^{13}$ and $R^{14}$ each preferably represents a hydrogen atom, an alkyl group, an amide group, a halogen atom, a sulfo group or a carboxyl group.

Formula (II) will be further described hereinafter. In formula (II), $X^2$ and $Y^2$ each represents a hydroxyl group, $—NR^{23}R^{24}$ or $—NHSO_2R^{25}$. $R^{21}$ and $R^{22}$ each represents a hydrogen atom or any substituent. Examples of such a substituent include those described with reference to $R^{11}$ to $R^{14}$. $R^{21}$ and $R^{22}$ may together form a carbon ring or heterocyclic group (preferably a 5- to 7-membered ring). $R^{23}$ and $R^{24}$ each represents a hydrogen atom, an alkyl, aryl or heterocyclic group. The details of these alkyl, aryl and heterocyclic groups are the same as those of $R^{15}$ and $R^{16}$. $R^{23}$ and $R^{24}$ may together form a nitrogen-containing heterocyclic group (preferably a 5- to 7-membered ring). $R^{25}$ represents an alkyl, aryl, amino or heterocyclic group. The details of these alkyl, aryl, amino and heterocyclic groups are the same as those of $R^{17}$.

In formula (II), at least one of $X^2$ and $Y^2$ is preferably a hydroxyl group, and more preferably $X^2$ and $Y^2$ each is a hydroxyl group. $R^{21}$ and $R^{22}$ each preferably represents a hydrogen atom, an alkyl group or an aryl group or together form a carbon ring or heterocyclic group. The details of these groups are the same as those of $R^{15}$ and $R^{16}$.

Formula (III) is further described hereinafter. In formula (III), $X^3$ represents a hydroxyl group or $—NR^{32}R^{33}$. $Y^3$ represents —CO— or $—SO_2—$. $R^{31}$ represents a hydrogen atom or any substituent (e.g., those described with reference to $R^{11}$ to $R^{14}$). The suffix n represents an integer 0 or 1.

$R^{32}$ and $R^{33}$ each represents a hydrogen atom, an alkyl, aryl or heterocyclic group. The details of these groups are the same as those of $R^{15}$ and $R^{16}$. $R^{31}$ and $R^{32}$, and $R^{32}$ and $R^{33}$ may together form a nitrogen-containing heterocyclic group (preferably a 5- to 7-membered ring).

In formula (III), $X^3$ preferably represents $—NR^{32}R^{33}$. $Y^3$ preferably represents —CO—. $R^{31}$ preferably represents a hydrogen atom, an alkyl, aryl, alkoxy, aryloxy or amino group. These groups may be further substituted by any substituents (e.g., those described with reference to $R^{11}$ to $R^{14}$). $R^{32}$ and $R^{33}$ each preferably represents a hydrogen atom or an alkyl group.

Specific examples of alkyl groups represented by $R^{34}$ and heterocyclic rings formed by $R^{31}$ and $R^{34}$ are same as those described for formula (I) and formula (II).

Specific examples of the compounds represented by formulae (I), (II) and (III) to be used in the present invention will be set forth below, but the present invention should not be construed as being limited thereto:

(I)-1
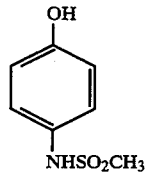
(I)-2
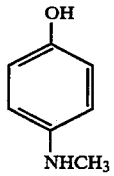
(I)-3
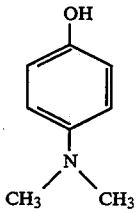
(I)-4
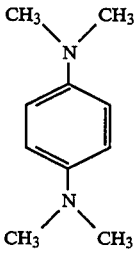
(I)-5
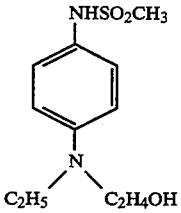
(I)-6
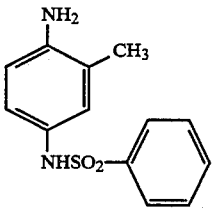
(I)-7
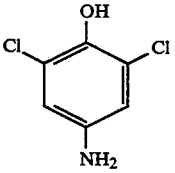
(I)-8
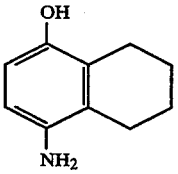
-continued
(I)-9
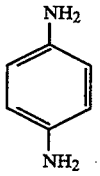
(I)-10
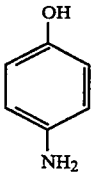
(I)-11
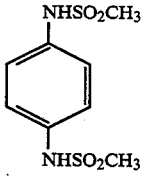
(I)-12
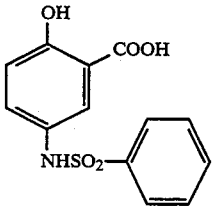
(I)-13
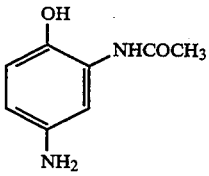
(I)-14
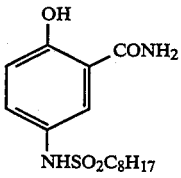
(I)-15
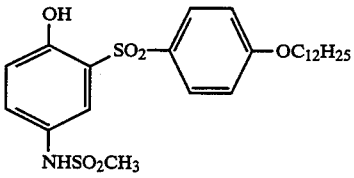
(I)-16
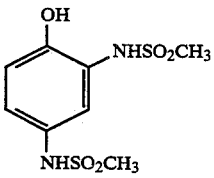
(II)-1
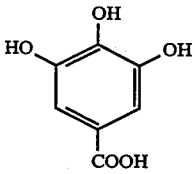

-continued
(II)-2
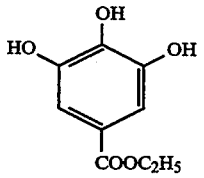
(II)-3
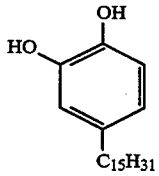
(II)-4
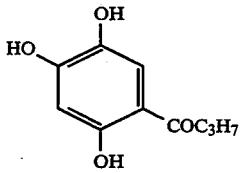
(II)-5
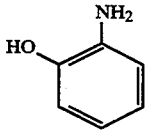
(II)-6
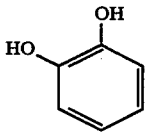
(II)-7
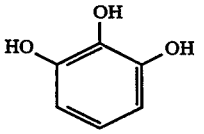
(II)-8
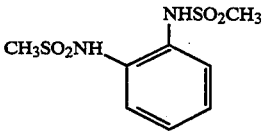
(II)-9
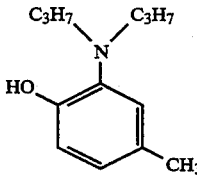
(II)-10
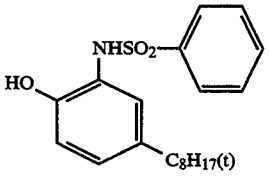
(II)-11
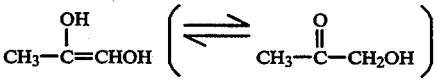
-continued
(II)-12
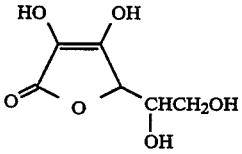
(II)-13
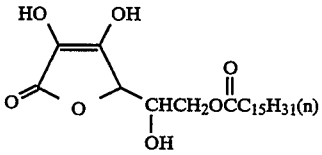
(II)-14
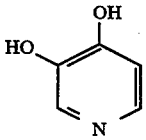
(II)-15
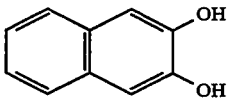
(III)-1
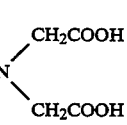
(III)-2
(III)-3
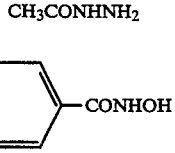
(III)-4
(III)-5
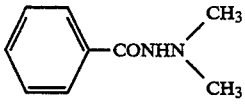
(III)-6
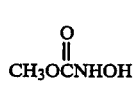
(III)-7
(III)-8
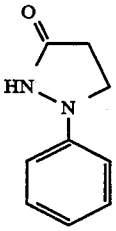
(III)-9
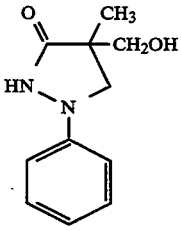

-continued (III)-10

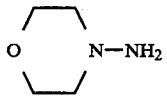

(III)-11

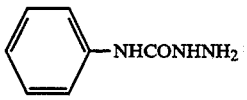

$NH_2NHCONHNH_2$ (III)-12

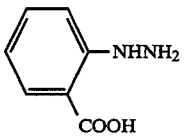

(III)-13

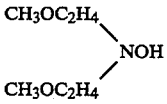

(III)-14

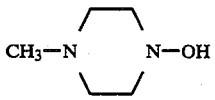

$CH_3NHNHCH_3$ (III)-15

$(t)C_4H_9NHOH$ (III)-16

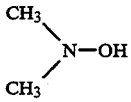

(III)-17

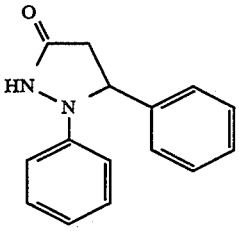

(III)-18

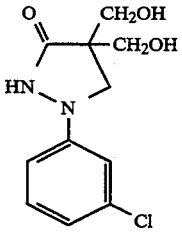

(III)-19

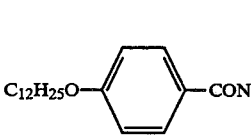

(III)-20

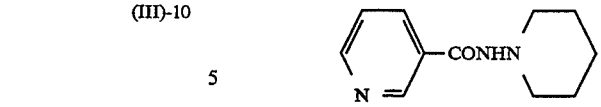

(III)-21

(III)-22

-continued (III)-23

(III)-24

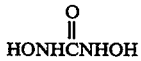

(III)-25

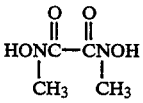

(III)-26

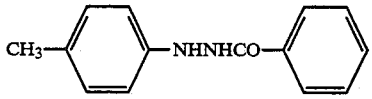

(III)-27

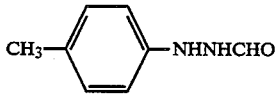

In the average halogen composition of silver halide grains contained in the at least one emulsion used in certain embodiments of the invention, the silver chloride content is 90 mol % or more. The average halogen composition of all silver halides constituting the silver halide grains contained in the emulsion comprises silver chloride in a proportion of 95 mol % or more. Preferably, it is substantially free of silver iodide. The term "being substantially free of silver iodide" as used herein means "having a silver iodide content of 1.0 mol % or less". More preferably, the halogen composition comprises silver chloride in a proportion of 98 mol % or more of all silver halides constituting silver halide grains and is silver bromochloride or silver chloride substantially free of silver iodide.

In other embodiments of the invention, the silver halide emulsion to be used in the present invention comprises silver bromochloride grains having a silver chloride content of 80 mol % or more. This means that the average halogen composition of the silver halide grains contained in the emulsion of those embodiments of the present invention is silver bromochloride comprising silver chloride in a proportion of 80 mol % or more and is substantially free of silver iodide. The term "being substantially free of silver iodide" as used herein means "preferably having a silver iodide content of 1.0 mol % or less". The average halogen composition of silver halide grains for use in certain embodiments of the invention is preferably silver bromochloride comprising silver chloride in a proportion of 95 mol % or more, more preferably 99 mol % or more, and substantially free of silver iodide.

The silver halide grains of the present invention preferably comprise localized phases having a silver bromide content of more than at least 10 mol %. The position of such localized phases having a high silver bromide content needs to be in the vicinity of the surface of grains to accomplish the effects of the present invention and in the light of pressure properties, dependency on the composition of processing solution, etc. The term "the vicinity of the surface of grains" as used herein means a "position within 1/5, preferably 1/10, of the size of silver halide grains from the surface thereof". The most preferred arrangement of localized phases having a high silver bromide content is a localized phase having a silver bromide content of more than at least 10 mol % epitaxially grown on the corners of cubic or tetradecahedral silver chloride grains.

The silver bromide content of such localized phases is preferably more than 10 mol %. However, if the silver bromide content is too high, the photographic light-sensitive material may be provided with undesirable characteristics. Thus, the photographic light-sensitive material may exhibit desensitization when pressurized or a great change in sensitivity and gradation due to fluctuations in the composition of processing solution. Taking these points into account, the silver bromide content of localized phases having a high silver bromide content is preferably 80 mol % or less, more preferably 70 mol % or less and particularly preferably in the range of 10 to 60 mol %, most preferably 20 to 50 mol %. The silver bromide content of localized phases having a high silver bromide content can be determined by an X-ray analysis method as described in Nihon Kagakukai, *Shinjikken Kagaku Koza* 6; *Kozo Kaiseki*, Maruzen.

The localized phase having a high silver bromide content preferably comprises 0.1 to 20%, more preferably 0.2 to 7% and particularly preferably 0.5 to 7%, of all silver contents constituting silver halide grains contained in the emulsion of the present invention.

The interface of such a localized phase having a high silver bromide content with other phases may be a definite phase boundary or a transition region having a gradation of halogen composition.

The formation of such a localized phase having a high silver bromide content can be accomplished by various methods. For example, a soluble silver salt and a soluble halogen salt may be reacted with each other in a single jet process or double jet process to form a localized phase. A conversion method in which silver halide grains which have been already formed are converted to silver halide grains having a lower solubility product may be used to form a localized phase. For example, a solution of a water-soluble bromide may be added to cubic or tetradecahedral silver halide host grains, or finely divided silver bromide or silver bromochloride grains having a small average diameter and a higher silver bromide content than the silver halide host grains may be mixed with the silver halide host grains, and then ripened to form a localized phase having a high silver bromide content.

The formation of a localized phase having a high silver bromide content is preferably effected in the presence of an iridium compound. This means that an iridium compound is supplied at the same time as, shortly before, or shortly after, the supply of silver or halogen to be used for the formation of a localized phase. For example, if a solution of a water-soluble bromide is added to form a localized phase having a high silver bromide content, the solution may previously contain an iridium compound, or another solution containing an iridium compound may be added to the system at the same time. If finely divided silver halide grains having a smaller average grain diameter and a higher silver bromide content than the silver halide host grains are mixed with the silver halide host grains, and then ripened to form a localized phase having a high silver bromide content, finely divided silver halide grains having a high silver bromide content may comprise an iridium compound previously incorporated therein. Such an iridium compound may be present during the formation of phases other than the localized phase having a high silver bromide content. The localized phase having a high silver bromide content is preferably formed with at least 50%, more preferably 80%, of all iridium content to be added to the system.

The iridium compound to be used in the present invention can be a water-soluble iridium compound. Examples of such a water-soluble iridium compound include a halogenated iridium (III) compound, a halogenated iridium (IV) compound, and an iridium complex salt having ligands such as halogen, amines and oxalate, e.g., hexachloroiridium (III) or (IV) complex salt, hexaammineiridium (III) or (IV) complex salt, and trisoxalatoiridium (III) or (IV) complex salt. In the present invention, any combination of trivalent and tetravalent compounds selected from these iridium compounds can be used. These iridium compounds may be used in the form of solution in water or another suitable solvent. A commonly used method for stabilizing the iridium compound solution can be used. That is, an aqueous solution of a halogenated hydrogen (e.g., hydrochloric acid, bromic, hydrofluoric acid) or a halogenated alkali (e.g., KCl, NaCl, KBr, NaBr) may be added to the iridium compound solution. Instead of using such a water-soluble iridium compound, other silver halide grains which have been previously doped with iridium may be added to and dissolved in the system during the preparation of silver halide grains of the present invention.

The total amount of the iridium compound to be added to the system during the preparation of silver halide grains of the present invention is preferably in the range of $5\times10^{-9}$ to $1\times10^{-4}$ mol, more preferably $1\times10^{-8}$ to $1\times10^{-5}$ mol, most preferably $5\times10^{-8}$ to $5\times10^{-6}$ mol, per mol of silver halide finally formed.

The silver halide grain of the present invention may have a face (100), a face (111), or both these faces, or a higher order face. A cubic or tetradecahedral silver halide grain mainly comprising a (100) face is preferred.

The size of the silver halide grains of the present invention may be within a commonly used range and is preferably in the range of 0.1 to 2 μm and more preferably 0.1 to 1.5 μm, as calculated in terms of average grain diameter. The grain diameter distribution may be either monodisperse or polydisperse, preferably monodisperse. The grain size distribution representing the degree of monodispersion is preferably in the range of 0.2 or less, more preferably 0.15 or less, as calculated in terms of the ratio (s/d) of statistical standard deviation (s) to average grain size (d). Two or more kinds of monodisperse emulsions may be preferably used in admixture.

For the purpose of providing a wide latitude, a blend of the above mentioned monodisperse emulsions may be preferably incorporated into the same layer or may be preferably coated in layers.

Silver halide grains contained in the photographic emulsion may have a regular crystal form such as cube, tetradecahedron and octahedron, an irregular crystal form such as sphere and tablet, or composite or mixture thereof. In the present invention, there may be preferably contained grains having a regular crystal form in a proportion of 50% or more, more preferably 70% or more, further preferably 90% or more.

Furthermore, an emulsion comprising tabular grains having an average aspect ratio (diameter calculated in terms of circle/thickness) of 5 or more, preferably 8 or more, in a proportion of more than 50% of all grains as calculated in terms of projected area may be preferably used.

The preparation of silver halide grains to be used in the present invention can be accomplished by any suitable method as disclosed in P. Glafkides, *Chimie et Physique Photographique*, Paul Montel, (1967), G. F. Duffin, *Photographic Emulsion Chemistry*, Focal Press, (1966), and V. L. Zelikman et al., *Making and Coating Photographic Emulsion*, Focal Press, (1964). In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which the pAg value of the liquid phase in which silver halide grains are formed is maintained constant, may also be used. According to the controlled double jet process, a silver halide emulsion having a regular crystal form and an almost uniform grain size can be obtained.

In addition to the above mentioned iridium compounds, various polyvalent metal ion dopants can be introduced into the silver halide emulsion to be used in the present invention during the formation or physical ripening of the emulsion grains. Examples of such dopant compounds include salts of cadmium, zinc, lead, copper and thallium, and salts or complex salts of the Group VIII elements such as iron, ruthenium, rhodium, palladium, osmium and platinum. In particular, the above mentioned Group VIII elements may be preferably used. The amount of such a compound to be added can vary widely depending on the purpose and is preferably in the range of $10^{-9}$ to $10^{-2}$ mol per mol of silver halide.

When the silver halide emulsion is subjected to selenium sensitization or gold sensitization, it is preferably subjected to both sensitizations in combination.

The selenium sensitizer to be used in the present invention can be one of the known selenium compounds as disclosed in the prior art patents. Selenium sensitization is normally carried out by adding an unstable type selenium compound and/or non-unstable type selenium compound to a silver halide emulsion, and then stirring the emulsion at an elevated temperature, preferably 40° C. or higher, for a predetermined period of time. Such an unstable type selenium compound may be preferably one of the compounds disclosed in EP0458278 and U.S. Pat. Nos. 3,297,446, 3,297,447 and 5,158,892. Specific examples of such an unstable type selenium compound include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl) selenide), selenophosphates, phosphineselenides, and colloidal metallic selenium.

Preferred examples of unstable type selenium compounds have been described above, but the invention is not limited to these compounds. Those skilled in the art generally understand that the specific structure of the unstable type selenium compound to be used as a sensitizer for photographic emulsion is not important so long as selenium is unstable and the organic portion of the selenium sensitizer molecule has no other role than to carry selenium and allow it to be present in the emulsion in an unstable form. In the present invention, unstable type selenium compounds in such varied forms may be advantageously used.

The non-unstable type selenium compound to be used in the present invention can be one of the compounds disclosed in U.S. Pat. Nos. 3,408,196 and 3,408,197. Examples of such a non-unstable type selenium compounds include selenious acid, potassium selenocyanate, selenazoles, quaternary salts thereof, diaryl selenide, diaryl diselenide, dialkyl selenide, dialkyl diselenide, 2-selenazolidinedione, 2-selenoxazolidinethione, and derivatives thereof.

Preferred among these selenium compounds are those represented by the following formula (IV) or (V):

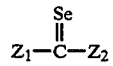

(IV)

wherein $Z_1$ and $Z_2$ may be the same or different and each represents an alkyl group (e.g., methyl, ethyl, t-butyl, adamantyl, t-octyl), an alkenyl group (e.g., vinyl, propenyl), an aralkyl group (e.g., benzyl, phenethyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, thienyl, furyl, imidazolyl), $—NR_1(R_2)$, $—OR_3$ or $—SR_4$.

$R_1$, $R_2$, $R_3$ and $R_4$ may be the same or different and each represents an alkyl group, an aralkyl group, an aryl group or a heterocyclic group. Examples of these alkyl, aralkyl, aryl and heterocyclic groups include those described in reference to $Z_1$ and $Z_2$.

Additionally, $R_1$ and $R_2$ may each represent a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl).

In formula (IV), $Z_1$ preferably represents an alkyl group, an aryl group or $—NR_1(R_2)$, and $Z_2$ preferably represents $—NR_5(R_6)$. $R_1$, $R_2$, $R_5$ and $R_6$ may be the same or different and each represents a hydrogen atom, an alkyl, aryl or acyl group.

Of the compounds represented by formula (IV), more preferred are N,N-dialkylselenourea, N,N,N'-trialkyl-N'-acylselenourea, tetraalkylselenourea, N,N-dialkylarylsenoamide or N-alkyl-N-arylarylselenoamide.

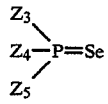

(V)

wherein $Z_3$, $Z_4$ and $Z_5$ may be the same or different and each represents an aliphatic group, an aromatic group, a heterocyclic group, $—OR_7$, $—NR_8(R_9)$, $—SR_{10}$, $—SeR_{11}$, —X or hydrogen atom.

The terms $R_7$, $R_8$, $R_9$, R10 and $R_{11}$ represent an aliphatic, aromatic or heterocyclic group. Additionally, $R_7$, $R_{10}$ and $R_{11}$ may represent a cation, and X represents a halogen atom.

In formula (V), the aliphatic group represented by $Z_3$, $Z_4$, $Z_5$, $R_7$, $R_8$, $R_9$, $R_{10}$ and $R_{11}$ represents a straight-chain, branched or cyclic alkyl group, alkenyl group, alkynyl group or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenethyl).

In formula (V), the aromatic group represented by $Z_3$, $Z_4$, $Z_5$, $R_7$, $R_8$, $R_9$, $R_{10}$ and $R_{11}$ represents a monocyclic or condensed aryl group (e.g., phenyl, pentafluorophenyl, 4-chlorophenyl, 3-sulfophenyl, α-naphthyl, 4-methylphenyl).

In formula (V), the heterocyclic group represented by $Z_3$, $Z_4$, $Z_5$, $R_7$, $R_8$, $R_9$, $R_{10}$ and $R_{11}$ represents a 3- to 10-membered saturated or unsaturated heterocyclic group containing at least one of a nitrogen atom, an oxygen atom and a sulfur atom (e.g., pyridyl, thienyl, furyl, thiazolyl, imidazolyl, benzimidazolyl).

In formula (V), the cation represented by $R_7$, $R_{10}$ and $R_{11}$ is an alkaline metal atom or ammonium, and the halogen atom represented by X is, e.g., fluorine atom, chlorine atom, bromine atom or iodine atom.

In formula (V), $Z_3$, $Z_4$ or $Z_5$ preferably represents an aliphatic group, an aromatic group or —$R_7$, and $R_7$ preferably represents an aliphatic or aromatic group.

Of the compounds represented by formula (V), more preferred are trialkylphosphine selenide, triarylphosphine selenide, trialkyl selenophosphate or triaryl selenophosphate.

Specific examples of the compound represented by formula (IV) or (V) are set forth below, but the present invention should not be construed as being limited thereto:

1. 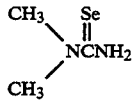

2. 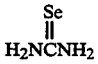

3. 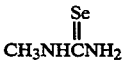

4. 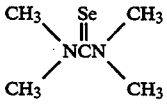

5. 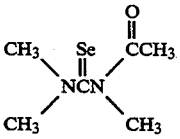

6. 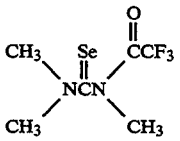

7. 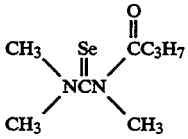

8. 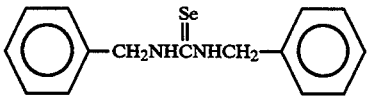

-continued

9. 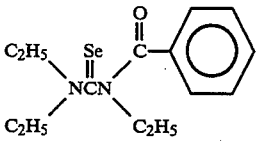

10. 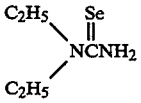

11. 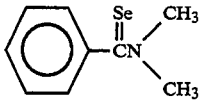

12. 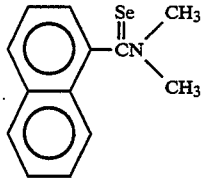

13. 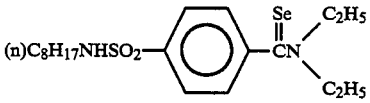

14. 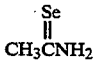

15. 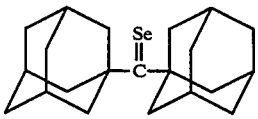

16. 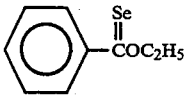

17. 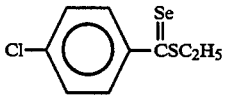

18. 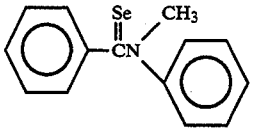

19. 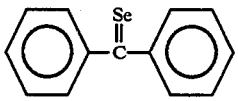

20. 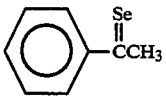

-continued

21.

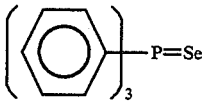

22.

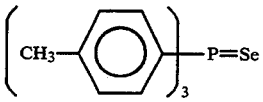

23. $(n\text{-}C_4H_9)_3P{=}Se$

24.

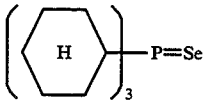

25.

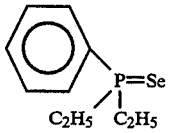

26.

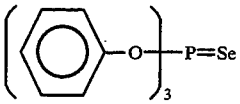

27.

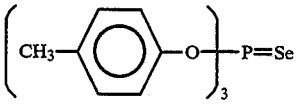

28. $(nC_4H_9)_3P{=}Se$

29.

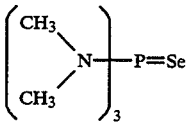

30. $(C_2H_5O)_3P{=}Se$

31.

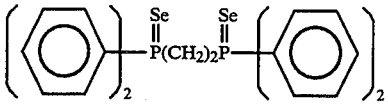

32. $(n\text{-}C_8H_{17})_3P{=}Se$

33.

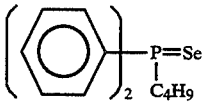

34.

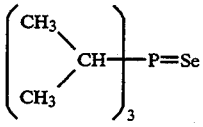

35.

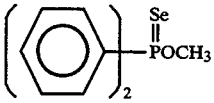

-continued

36.

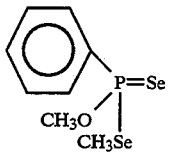

37.

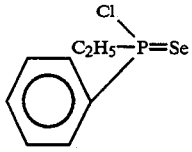

38.

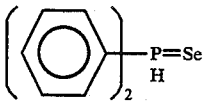

39. $(CH_3)_2P{=}Se$ $CH_3S$

The amount of the selenium sensitizer to be used varies with the selenium compound used, the silver halide grains used (kind and content of halogen, the grain size, crystal form), the chemical ripening conditions, etc., and is normally in the range of $10^{-8}$ to $10^{-4}$ mol, preferably $10^{-7}$ to $10^{-5}$ mol, per mol of silver halide.

The gold compound to be used in the present invention may be monovalent or trivalent in terms of gold oxidation number. Various gold compounds can be used. Typical examples of such compounds include tetrachloroauric acid (III), tetracyanoauric acid (III), tetrakis(thiocyanate)auric acid (III), alkaline metal salts thereof, bis(thiosulfate)aurite (I), and a complex ion or complex salt of dimethylrhodanateauric chloride (I).

The amount of such a gold compound to be added varies, but is generally in the range of $1\times10^{-7}$ to $1\times10^{-2}$ mol, preferably $1\times10^{-6}$ to $1\times10^{-3}$ mol, more preferably $2\times10^{-6}$ to $1\times10^{-4}$ mol, per mol of silver halide.

In the present invention, the chemical sensitization conditions are not specifically limited. The pAg value is normally in the range of 5 to 10, preferably 5.5 to 8, more preferably 6 to 7.5. The temperature is normally in the range of 30° to 80° C., preferably 40° to 70° C. The pH value is normally in the range of 4 to 10, preferably 5 to 8.

When selenium sensitization or gold sensitization is carried out in the present invention, the surface of the silver halide grains is preferably subjected to selenium sensitization or/and gold sensitization after the formation of a localized phase having a high silver bromide content. Besides selenium sensitization and gold sensitization, sulfur sensitization can be used as a chemical sensitization. Furthermore, when selenium sensitization or gold sensitization is carried out, reduction sensitization or sulfur sensitization can be used in combination with these sensitizing methods.

The chemical sensitization with sulfur applied for the present invention is carried out with an active gelatin or a sulfur-containing compound which can react with silver (e.g., thiosulfates, thioureas, mercapto compounds, rhodanines). Specific examples of these compounds are disclosed in U.S. Pat. Nos. 1,574,944, 2,278,947, 2,410,689, 2,728,668, and 3,656,955.

The objects of the present invention can be more effectively accomplished by incorporating at least one of mercaptoheterocyclic compound represented by the following formula (a), (b) or (c) into the silver halide emulsion layer which has been chemically sensitized with a gold compound:

(a)

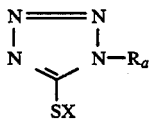

(b)

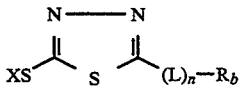

(c)

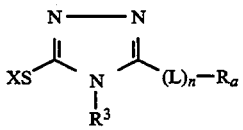

wherein $R_a$ represents an alkyl, alkenyl or aryl group; X represents a hydrogen atom, an alkali metal atom, an ammonium group or a precursor thereof; $R_b$ represents a hydrogen atom or $R_a$; L represents a divalent linking group; $R^3$ has the same meaning as $R_a$; and $R^3$ and $R_a$ may be the same or different.

Examples of the above mentioned alkali metal atom include a sodium atom and a potassium atom. Examples of the above mentioned ammonium group include a tetramethylammonium group and a trimethylbenzylammonium group. The above mentioned precursor is a group which can yield a hydrogen atom or an alkali metal under alkaline conditions and may be an acetyl group, a cyanoethyl group, a methanesulfonylethyl group, etc.

Among the above mentioned groups represented by $R_a$, the alkyl group and alkenyl group include substituted, unsubstituted and alicyclic groups. Examples of substituents in such substituted alkyl and alkenyl groups include a halogen atom, a nitro group, a cyano group, a hydroxyl group, an alkoxy group, a carbonylamino group, an acylamino group, an alkoxycarbonylamino group, a ureide group, an amino group, a heterocyclic group, an acyl group, a sulfamoyl group, a sulfonamide group, a thioureide group, a carbamoyl group, an alkylthio group, an arylthio group, a heterocyclic thio group, a carboxylic acid group, a sulfonic acid group, and salts thereof.

These ureide, thioureide, sulfamoyl, carbamoyl and amino groups include unsubstituted, N-alkyl-substituted and N-aryl-substituted groups.

Examples of such an aryl group represented by $R_a$ include a phenyl group and a substituted phenyl group. Examples of substituents in the substituted phenyl group include an alkyl group and the above mentioned substituents for the alkyl group.

Specific examples of divalent linking groups represented by L include

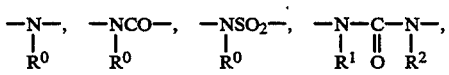

-continued

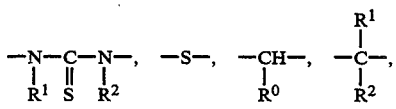

and a combination thereof.

The suffix n represents an integer 0 or 1 $R^0$, $R^1$ and $R^2$ each represents a hydrogen atom, an alkyl group or an aralkyl group.

Specific examples of compounds represented by formula (a), (b) or (c) are set forth below, but the present invention should not be construed as being limited thereto:

(a-1)

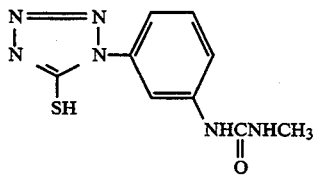

(a-2)

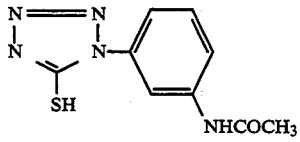

(b-1)

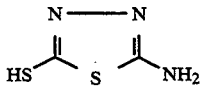

(b-2)

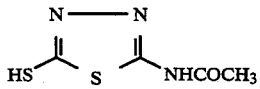

(c-1)

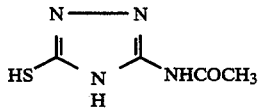

(c-2)

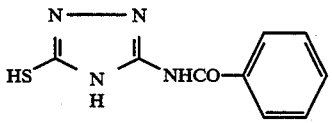

The preferable compounds to be used for chemical sensitization are those described in JP-A-62-215272, lower right column on page 18 to upper right column on page 22.

The spectral sensitization applied to the silver halide emulsion to be used in the present invention is effected for the purpose of providing each emulsion layer in the light-sensitive material of the present invention with a spectral sensitivity in a desired wavelength range. In the present invention, a dye which absorbs light having a wavelength corresponding to the desired spectral sensitivity, i.e., spectral sensitizing dye is preferably added to the system for this purpose. Examples of such a spectral sensitizing dye include those described in F. M. Hamer, *Heterocyclic Compounds—Cyanine Dyes and Related Compounds*, John Wiley & Sons, New York, London (1964). Specific preferred examples of such compounds and spectral sensitizing methods include those described in the above cited JP-A-62-215272, upper right column on page 22 to page 38.

The silver halide emulsion to be used in the present may comprise various compounds or precursors thereof for the purpose of inhibiting fogging during the preparation, storage or photographic processing of the light-sensitive material or stabilizing the photographic properties of the light-sensitive material. Specific preferred examples of these compounds include those described in the above cited JP-A-62-215272, pp. 39–72.

The emulsion to be used in the present invention is of the so-called surface latent image type in which a latent image is formed mainly on the surface of the grains.

The light-sensitive material of the present invention may preferably comprise a dye decolorable by processing (particularly oxonol dye) as described in European Patent 0,337,490A2 (pp. 27–76), in a hydrophilic colloidal layer in such an amount that the optical reflection density of the light-sensitive material at 680 nm reaches 0.70 or more. Or it may preferably comprise titanium oxide surface-treated with a dihydric to tetrahydric alcohol (e.g., trimethylolethane) or the like in a water-resistant resin layer in the support in an amount of 12 wt % or more, more preferably 14 wt % or more, for the purpose of improving image sharpness, etc.

Photographic additives such as cyan, magenta and yellow couplers to be used in the present invention are preferably used in the form of a solution in a high boiling organic solvent. Such a high boiling solvent can be any water-nonmiscible compound having a melting point of 100° C. or lower and a boiling point of 140° C. or higher which is a good solvent for couplers. The melting point of the high boiling organic solvent is preferably 80° C. or lower. The boiling point of the high boiling organic solvent is preferably 160° C. or higher, more preferably 170° C. or higher.

These high boiling organic solvents are further described in JP-A-62-215272, lower right column on page 137 to upper right column on page 144.

The cyan, magenta or yellow coupler may be emulsion-dispersed in an aqueous hydrophilic colloidal solution in the form of impregnation in a loadable latex polymer (as disclosed in U.S. Pat. No. 4,203,716) in the presence or absence of the above mentioned high boiling organic solvent or in the form of a solution in the above mentioned high boiling organic solvent with a water-insoluble, organic solvent-soluble polymer.

Single polymers or copolymers disclosed in U.S. Pat. No. 4,857,449, column 7 to column 15, and International Patent Disclosure WO88/00723, pp. 12–30 may be preferably used. More preferably, methacrylate or acrylamide polymers, particularly acrylamide polymers, can be used in light of stability of the dye image.

The light-sensitive material of the present invention preferably comprises a dye image preservability improving compound described in European Patent 0,277,589A2 in combination with couplers, particularly pyrazoloazole couplers.

That is, a compound which undergoes chemical coupling with an aromatic amine developing agent left after color development to produce a chemically inert and substantially colorless compound and/or a compound which undergoes chemical coupling with an oxidation product of an aromatic amine developing agent left after color development to produce a chemically inert and substantially colorless compound are preferably used simultaneously or singly, e.g., to inhibit the occurrence of stain or other side effects due to the production of developed dyes caused by the reaction of a color developing agent or its oxidation product left in the film during storage after processing.

The light-sensitive material of the present invention may preferably comprise an antimold compound disclosed in JP-A-63-271247 to inhibit the proliferation of various molds and bacteria that deteriorate images in the hydrophilic colloidal layer.

The support to be used for the light-sensitive material of the present invention can be a white polyester support for display or a support comprising a white pigment-containing layer provided on the side having the silver halide emulsion layer. In order to further improve the sharpness of images, an antihalation layer may be preferably coated on the silver halide emulsion layer side of the support or the other side thereof. In particular, the transmission density of the support is preferably set at 0.35 to 0.8 to make the display viewable on both reflected light and transmitted light.

The light-sensitive material of the present invention may be exposed to either visible light or infrared rays. In the exposure process, either low intensity exposure or high intensity-short time exposure may be used. In the latter case, a laser scanning exposure process in which the exposure time per pixel is less than $10^{-4}$ seconds is desirable.

In the exposure process, a band stop filter disclosed in U.S. Pat. No. 4,880,726 is preferably used. With such a band stop filter, light color stain can be removed, remarkably improving color reproducibility.

The light-sensitive material which has been exposed to light can be subjected to commonly used black-and-white development or color development. In the case of color light-sensitive materials, color development is preferably followed by blix for the purpose of rapid processing. In particular, if the above mentioned high silver chloride content emulsion is used, the pH value of the blix solution is preferably in the range of about 6.5 or less, more preferably about 6 or less, for the purpose of accelerating desilvering.

The silver halide emulsions, other materials (e.g., additives) and photographic constituent layers (e.g., layer arrangement) which can be applied to the light-sensitive material of the present invention, and the processing methods for processing the light-sensitive material and the processing additives therefor are those described in the following patents, particularly European Patent (EP) 0,355,660A2 (corresponding to JP-A-2-139544).

| Photographic constituent, etc. | JP-A-62-215272 | JP-A-2-33144 | EP0,355,660A2 |
|---|---|---|---|
| Silver halide emulsion | Line 6, upper right column on p. 10 - line 5, lower left column on p. 12 & last line 4, lower right column on p. 12 - line 17, upper | Line 16, upper right column on p. 28 - line 11, lower right column on p. 29 & line 2-line 5 on p. 30 | Line 53 on p. 45 - line 3 on p. 47 & line 20-line 22 on p. 47 |

-continued

| Photographic constituent, etc. | JP-A-62-215272 | JP-A-2-33144 | EP0,355,660A2 |
|---|---|---|---|
| | left column on p. 13 | | |
| Silver halide solvent | Line 6–line 14, lower left column on p. 12 & last line 3, upper left column on p. 13 - last line, lower left column on p. 18 | — | — |
| Chemical sensitizer | Last line 3, lower left column on p. 12 - last line 5, lower right column on p. 12 & line 1, lower right column on p. 18 - last line 9, upper right column on p. 22 | Line 12 - last line, lower right column on p. 29 | Line 4–line 9 on p. 47 |
| Spectral sensitizer (spectral sensitizing method) | Last line 8, upper right column on p. 22 - last line on p. 38 | Line 1–line 13, upper left column on p. 30 | Line 10–line 15 on p. 47 |
| Emulsion stabilizer | Line 1, upper left column on p. 39 - last line, upper right column on p. 72 | Line 14, upper left column - line 1, upper right column on p. 30 | Line 16–line 19 on p. 47 |
| Development accelerator | Line 1, lower left column on p. 72 - line 3, upper right column on p. 91 | — | — |
| Color coupler (cyan, magenta, yellow coupler) | Line 4, upper right column on p. 91 - line 6, upper left column on p. 121 | Line 14, upper right column on p. 3 - last line, upper left column on p. 18 & line 6, upper right column on p. 30 - line 11, lower right column on p. 35 | Line 15–line 27 on p. 4 & line 30 on p. 5 last line on p. 28 line 29 on p. 45 - line 31 on p. 45 & line 23 on p. 47 - line 50 on p. 63 |
| Color intensifier | Line 7, upper left column on p. 121 - line 1, upper right column on p. 125 | — | — |
| Ultraviolet absorbent | Line 2, upper right column on p. 125 - last line, lower left column on p. 127 | Line 14, lower right column on p. 37 - line 11, upper left column on p. 38 | Line 22–line 31 on p. 65 |
| Discoloration inhibitor (image stabilizer) | Line 1, upper right column on p. 127 - line 8, lower left column on p. 137 | Line 12, upper right column on p. 36 - line 19, upper left column on p. 37 | Line 30 on p. 4 - line 23 on p. 5 & line 1 on 29 - line 25 on p. 45 & line 33 - line 40 on p. 45 & line 2–line 21 on p. 65 |
| High boiling and/or low boiling organic solvent | Line 9, lower left column on p. 137 - last line, upper right column on p. 144 lower | Line 14, lower right column on p. 35 - line 4, lower left column on p. 36 | Line 1–line 51 on p. 64 |
| Method for dispersing photographic additives | Line 1, upper left column on p. 144 - line 7, upper right column on p. 146 | Line 10, lower right column on p. 27 - last line, upper left column on p. 28 & line 12, lower right column on p. 35 - line 7, upper right column on p. 36 | Line 51 on p. 63 line 56 on p. 64 |
| Film hardener | Line 8, upper right column on p. 146 - line 4, lower left column on p. 155 | — | — |
| Developing agent precursor | Line 5, lower left column on p. 155 - line 2, lower right column on p. 155 | — | — |
| Development inhibitor-releasing compound | Line 3–line 9, lower right column on p. 155 | — | — |
| Support | Line 19, lower right column on p. 155 - line 14, upper left column on p. 156 | Line 18, upper right column on p. 38 - line 3, upper left column on p. 39 | Line 29 on p. 66 line 13 on p. 67 |
| Structure of light-sensitive layer | Line 15, upper left column on p. 156 - line 14, lower right column on p. 156 | Line 1–line 15, upper right column on p. 28 | Line 41–line 52 on p. 45 |
| Dye | Line 15, lower right column on p. 156 - last line, lower right column on p. 184 | Line 12, upper left column - line 7, upper right column on p. 38 | Line 18–line 22 on p. 66 |
| Color stain inhibitor | Line 1, upper left column on p. 185 - line 3, lower right column on p. 188 | Line 8–line 11, upper right column on p. 36 | Line 57 on p. 64 line 1 on p. 65 |

-continued

| Photographic constituent, etc. | JP-A-62-215272 | JP-A-2-33144 | EP0,355,660A2 |
|---|---|---|---|
| Gradation adjustor | Line 4 - line 8, lower right column on p. 188 | — | — |
| Stain inhibitor | Line 9, upper right column on p. 188–line 10, lower right column on p. 193 | Last line, upper left column - line 13, lower right column on p. 37 | Line 32 on p. 65 line 17 on p. 66 |
| Surfactant | Line 1, lower left column on p. 201 - last line, upper right column on p. 210 | Line 1, upper right column on p. 18 - last line, lower right column on p. 24 & last line 10, lower left column on p. 27 - line 9, lower right column on p. 27 | — |
| Fluorine-containing compound (antistatic agent, coating aid, lubricant, adhesion inhibitor) | Line 1, lower left column on p. 210 - line 5, lower left column on p. 222 | Line 1, upper left column on p. 25 - line 9, lower right column on p. 27 | — |
| Binder (hydrophilic colloid) | Line 6, lower left column on p. 222 - last line, upper left column on p. 225 | Line 8–line 18, upper left column on p. 38 | Line 23–line 28 on p. 66 |
| Thickening agent | Line 1, upper right column on p. 225 - line 2, upper right column on p. 227 | — | — |
| Antistatic agent | Line 3, upper right column on p. 227 - line 1, upper left column on p. 230 | — | — |
| Polymer latex | Line 2, upper left column on p. 230 - last line on p. 239 | — | — |
| Matting agent | Line 1, upper left column on p. 240 - last line, upper right column on p. 240 | — | — |
| Photographic processing method (processing step, additives) | Line 7, upper right column on p. 3 - line 5, upper right column on p. 10 | Line 4, upper left column on p. 39 - last line, upper left column on p. 42 | Line 14 on p. 67 line 28 on p. 69 |

(Note) The contents cited in JP-A-62-215272 include the contents described in the written amendment of procedure dated March 16, 1987 attached thereto.

Among the above mentioned color couplers, the yellow couplers may be the short wave type yellow couplers disclosed in JP-A-63-231451, JP-A-63-123047, JP-A-63-241547, JP-A-1-173499, JP-A-1-213648, and JP-A-1-250944.

The cyan couplers may be the 3-hydroxypyridine cyan couplers disclosed in European Patent (EP) 0,333,185A2 (particularly those which have been rendered two-equivalent by incorporating a chlorine-separatable group in Coupler (42) exemplified as a specific example, Coupler (6), Coupler (9)) or cyclic active methylene cyan couplers as disclosed in JP-A-64-32260 (particularly Coupler Examples 3, 8, 34 exemplified as specific examples) besides the diphenylimidazole cyan couplers disclosed in JP-A-2-33144.

As a process for the processing of a silver halide photographic material comprising a high silver chloride content emulsion having a high silver chloride content of 90 mol % or more one can preferably use the one described in JP-A-2-207250, upper left column, page 27, to upper right column, page 34.

The present invention will be further described hereinafter, but the present invention should not be construed as being limited thereto.

EXAMPLE 1

Thirty-two g of lime-treated gelatin was dissolved in 800 cc of distilled water at a temperature of 40° C. Sodium chloride in the amount of 5.76 g was added to the solution which was then heated to a temperature of 75° C. To this solution was added 1.8 cc of a 1% aqueous solution of N,N'-dimethylimidazolidine-2-thione. A solution of 100 g of silver nitrate in 400 cc of distilled water and a solution of 34.4 g of sodium chloride in 400 cc of distilled water were then added to the solution over 53 minutes while the temperature of the system was kept at 75° C. A solution of 60 g of silver nitrate in 200 cc of distilled water and a solution of 17.4 g of sodium chloride in 200 cc of distilled water were then added to the solution over 18 minutes while the temperature of the system was kept at 75° C.

The material was then desalted and rinsed at a temperature of 40° C. Ninety g of lime-treated gelatin was added to the material, and sodium chloride and sodium hydroxide were then added to the material so that the pAg and pH values thereof were adjusted to 7.5 and 6.5, respectively. The material was then heated to a temperature of 58° C.

A blue-sensitive sensitizing dye of the structural formula shown below was added to the material in an amount of $3\times10^{-4}$ mol per mol of silver halide. The emulsion was then subjected to optimum sulfur sensitization with triethylthiourea in an amount of $6\times10^{-6}$ mol per mol of silver halide. The resulting silver chloride emulsion was used later as Emulsion A. To a coating solution containing Emulsion A, Compound (a-1) was added in an amount of $3\times10^{-4}$ mol per mol of silver chloride in the blue-sensitive emulsion.

Emulsion A was then measured for grain shape, size and size distribution by electron microphotography. The grain size is represented by the average of the diameter of circles equivalent to the projected area of the grains. The grain size distribution is obtained by dividing the standard deviation of grain diameters by the average grain size. Emulsion A comprised cubic grains with an average grain size of 0.82 μm and a grain size distribution of 0.10.

A polyethylene double-laminated paper support was subjected to corona discharge. On the surface of the support was then coated a gelatin subbing layer containing sodium dodecylbenzenesulfonate. Further, various photographic constituent layers were coated on the subbing layer to prepare a multilayer color photographic paper having the following layer structure (Specimen A). The various coating solutions were prepared as follows:

Preparation of 1st layer coating solution

A yellow coupler (ExY) in an amount of 19.1 g, 4.1 g of a dye image stabilizer (Cpd-1) and 0.7 g of a dye image stabilizer (Cpd-7) were dissolved in a mixture of 27.2 cc of ethyl acetate, 4.1 g of a solvent (Solv-3) and 4.1 g of a solvent (Solv-7). This solution was added to 185 cc of a 10% aqueous solution of gelatin containing 8 cc of sodium dodecylbenzenesulfonate. The mixture was then subjected to emulsion dispersion by means of an ultrasonic homogenizer. The resulting dispersion was mixed with the silver chloride Emulsion A to prepare a 1st layer coating solution.

The coating solutions for the 2nd to 7th layers were prepared in the same manner as for the 1st layer. The gelatin hardener for each layer was a sodium salt of 1-oxy-3,5-dichloro-s-triazine.

To each of these layers were added Cpd-10 and Cpd-11 in amounts of 25.0 mg/m$^2$ and 50.0 mg/m$^2$, respectively, as preservatives.

As spectral sensitizing dyes to be incorporated into these layers there were used the following compounds:

Sensitizing Dye A for blue-sensitive emulsion layer

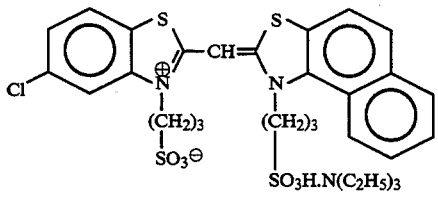

Sensitizing Dye C for green-sensitive emulsion layer

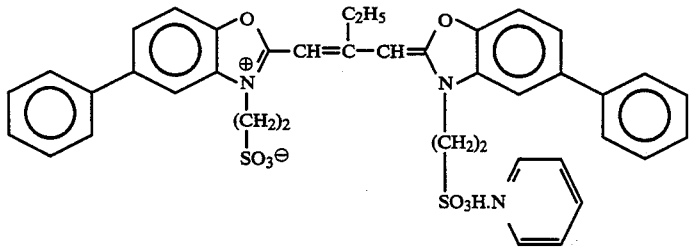

(4.0 × 10$^{-4}$ mol per mol of silver halide)

Sensitizing Dye D for green-sensitive emulsion layer

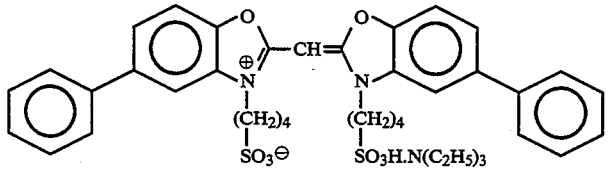

(9.0 × 10$^{-5}$ mol per mol of silver halide)

Sensitizing Dye E for red-sensitive emulsion layer

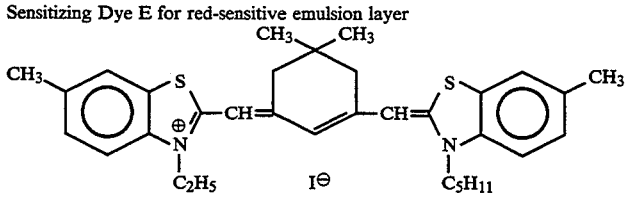

(9 × 10$^{-5}$ mol per mol of silver halide)

To the red-sensitive emulsion layer was added the following compound in an amount of 2.6×10$^{-3}$ mol per mol of silver halide.

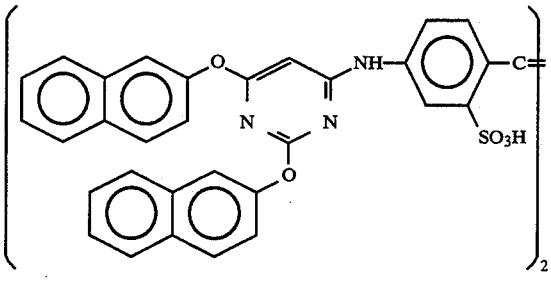

For the purpose of inhibiting irradiation, to the emulsion layer were added the following dyes (the figure in the parenthesis indicating the coated amount):

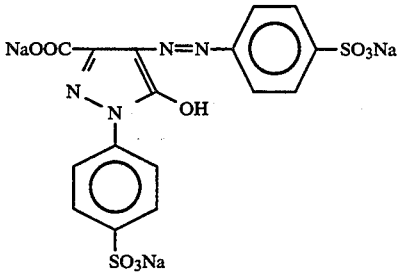

(10 mg/m²)

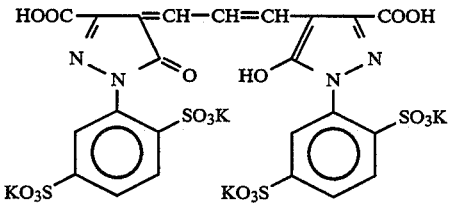

(10 mg/m²)

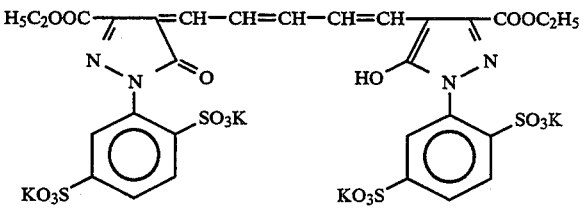

(40 mg/m²)

and

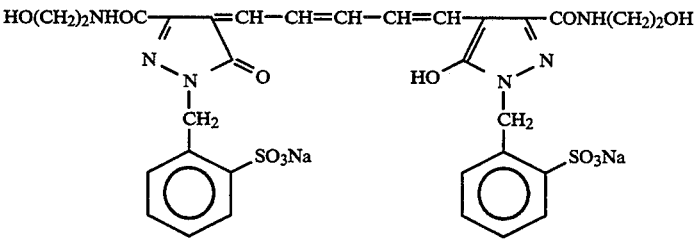

(20 mg/m²)

(Layer Arrangement)

The composition of the various layers are set forth below. The figure indicates the coated amount (g/m²). The coated amount of silver halide emulsion is represented as calculated in terms of silver.

| | |
|---|---|
| Support: | |
| Polyethylene-laminated paper [containing a white pigment ($TiO_2$) and a bluish dye (ultramarine) in polyethylene on the 1st layer side] | |
| 1st Layer (blue-sensitive yellow coloring layer): | |
| Silver chloride Emulsion A | 0.30 |
| Gelatin | 1.22 |
| Yellow Coupler (ExY) | 0.82 |
| Dye Image Stabilizer (Cpd-1) | 0.19 |
| Solvent (Solv-3) | 0.18 |
| Solvent (Solv-7) | 0.18 |
| Dye Image Stabilizer (Cpd-7) | 0.06 |
| 2nd Layer (color stain inhibiting layer): | |
| Gelatin | 0.64 |
| Color Stain Inhibitor (Cpd-5) | 0.10 |
| Solvent (Solv-l) | 0.16 |
| Solvent (Solv-4) | 0.08 |
| 3rd Layer (green-sensitive magenta coloring layer): | |
| Silver bromochloride emulsion (1:3 (Ag molar ratio) of a large size emulsion comprising cubic grains with an average size of 0.55 μm and a grain size fluctuation coefficient of 0.10 and a small size emulsion comprising cubic grains with an average size of 0.39 μm and a grain size fluctuation coefficient of 0.08; both emulsions comprising 0.8 mol % of AgBr localized partially on the surface of grains) | 0.12 |
| Gelatin | 1.28 |
| Magenta Coupler (ExM) | 0.23 |

-continued

| | |
|---|---|
| Dye Image Stabilizer (Cpd-2) | 0.03 |
| Dye Image Stabilizer (Cpd-3) | 0.16 |
| Dye Image Stabilizer (Cpd-4) | 0.02 |
| Dye Image Stabilizer (Cpd-9) | 0.02 |
| Solvent (Solv-2) | 0.40 |
| 4th Layer (ultraviolet absorbing layer): | |
| Gelatin | 1.41 |
| Ultraviolet Absorbent (UV-1) | 0.47 |
| Color Stain Inhibitor (Cpd-5) | 0.05 |
| Solvent (Solv-5) | 0.24 |
| 5th Layer (red-sensitive cyan coloring layer): | |
| Silver bromochloride emulsion (1:4 (Ag molar ratio) of a large size emulsion comprising cubic grains with an average size of 0.58 μm and a grain size fluctuation coefficient of 0.09 and a small size emulsion comprising cubic grains with an average size of 0.45 μm and a grain size fluctuation coefficient of 0.11; both emulsions comprising 0.6 mol % of AgBr localized partially on the surface of grains) | 0.23 |
| Gelatin | 1.04 |
| Cyan Coupler (ExC) | 0.32 |
| Dye Image Stabilizer (Cpd-2) | 0.03 |
| Dye Image Stabilizer (Cpd-4) | 0.02 |
| Dye Image Stabilizer (Cpd-6) | 0.18 |
| Dye Image Stabilizer (Cpd-7) | 0.40 |
| Dye Image Stabilizer (Cpd-8) | 0.05 |
| Solvent (Solv-6) | 0.14 |
| 6th Layer (ultraviolet absorbing layer): | |
| Gelatin | 0.48 |
| Ultraviolet Absorbent (UV-1) | 0.16 |
| Color Stain Inhibitor (Cpd-5) | 0.02 |
| Solvent (Solv-5) | 0.08 |
| 7th Layer (protective layer): | |
| Gelatin | 1.10 |
| acryl-modified copolymer of polyvinyl alcohol (modification degree: 17%) | 0.17 |
| Liquid paraffin | 0.03 |

Yellow Coupler (ExY)

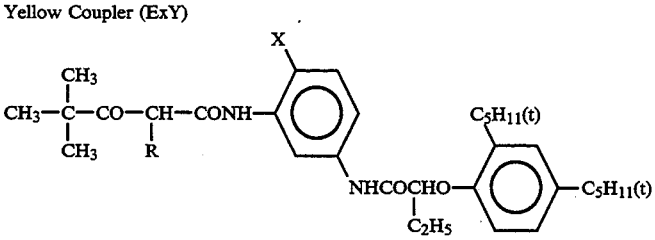

1:1 (molar ratio) mixture of: R = 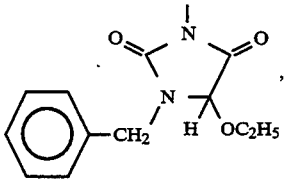 , X = Cl and R = 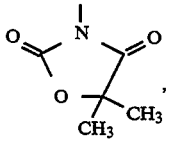 , X = $OCH_3$ Magenta Coupler (ExM)

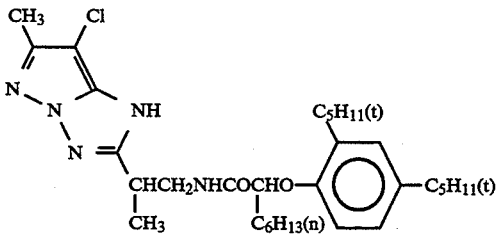

Cyan Coupler (ExC)

1:1 (molar ratio) of:

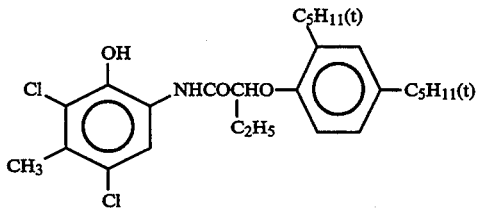

and

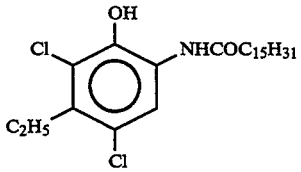

Dye Image Stabilizer (Cpd-1)

-continued
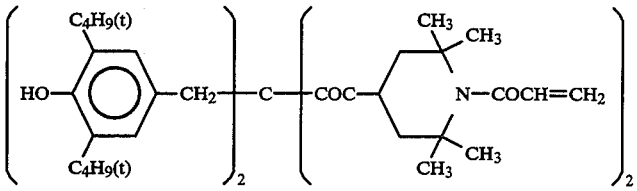
Dye Image Stabilizer (Cpd-2)
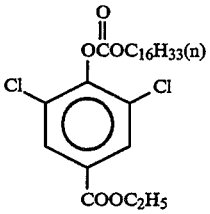
Dye Image Stabilizer (Cpd-3)
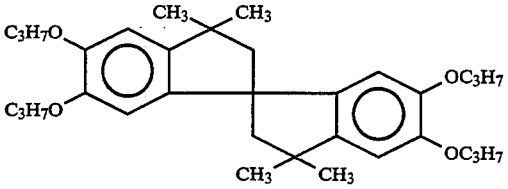
Dye Image Stabilizer (Cpd-4)
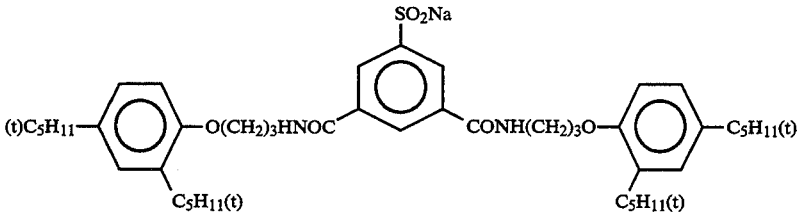
Color Stain Inhibitor (Cpd-5)
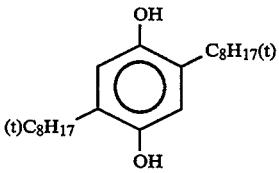
Dye Image Stabilizer (Cpd-6)
2:4:4 (weight ratio) mixture of:
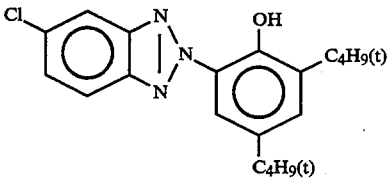
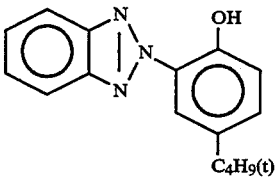

-continued
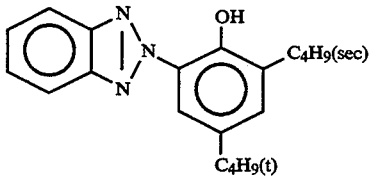
Dye Image Stabilizer (Cpd-7)
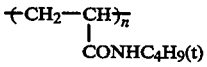
(Average molecular weight: 60,000)
Dye Image Stabilizer (Cpd-8)
1:1 (weight ratio) mixture of:
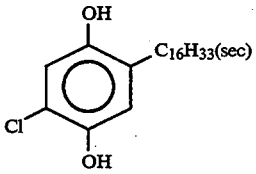
and
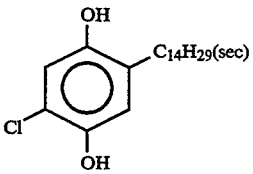
Dye Image Stabilizer (Cpd-9)
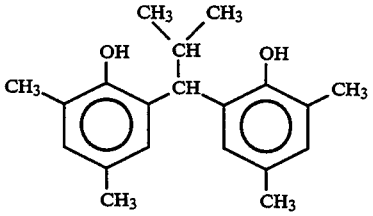
Preservative (Cpd-10)
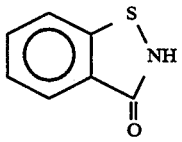
Preservative (Cpd-11)
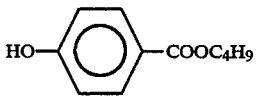
Ultraviolet Absorbent (UV-1)
4:2:4 (weight ratio) mixture of:
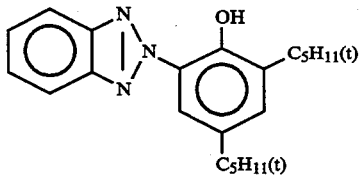
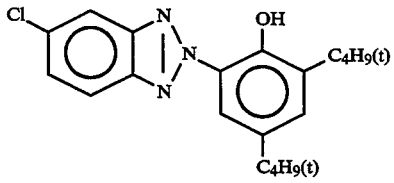

-continued

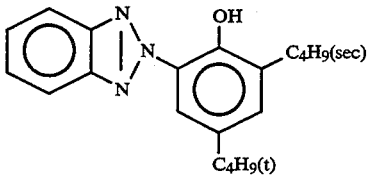

Solvent (Solv-1)

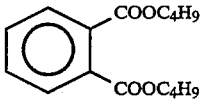

Solvent (Solv-2)
1:1 mixture (volumetric ratio) of:

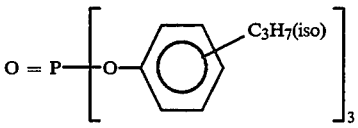

and

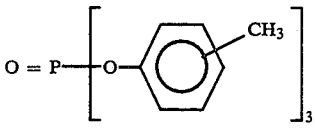

Solvent (Solv-3)
$O=P\text{-}[O\text{-}C_9H_{19}(iso)]_3$

Solvent (Solv-4)

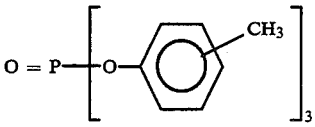

Solvent (Solv-5)
$(CH_2)_8(COOC_8H_{17})_2$

Solvent (Solv-6)
80:20 (volumetric ratio) mixture of:

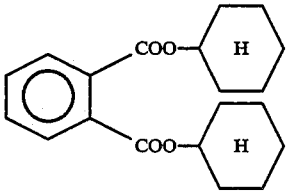

and

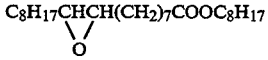

Solvent (Solv-7)
$C_8H_{17}CHCH(CH_2)_7COOC_8H_{17}$
O

Other light-sensitive material specimens were prepared as Specimens B to J in the same manner as Specimen A except that the emulsion to be incorporated into the 1st (blue-sensitive layer) was replaced by Emulsion B and the compound set forth in Table 1 were added to the 1st layer coating solution, respectively.

In order to examine the sensitivity of the light-sensitive materials and the fluctuations of the photographic sensitivity due to the change in the humidity upon exposure, the light-sensitive materials were stored in an atmosphere of 25° C.-55% RH and 25° C.-85% RH where they were exposed to light through an optical wedge and a blue filter for 0.1 second. These light-sensitive materials were then subjected to color development with the processing solutions described later in the processing steps described later. The sensitivity (S) is represented by the reciprocal of the exposure required to give a density 0.5 higher than fog density when exposed at 25° C. and 55% RH, relative to that of Specimen A as 100. The sensitivity change (ΔS humidity) is represented by the difference in the logarithm of the exposure required to give a density 0.5 higher than fog density. If this value is negative, it means desensitization upon exposure under a high humidity.

For evaluation of the change in photographic properties after prolonged storage of the light-sensitive materials, the specimens were stored in an atmosphere of 60° C.-40% RH for 2 days, subjected to the same exposure and processing as described above, and then measured for the fog density change (ΔS storage) from the initial value.

The results are set forth in Table 1.

TABLE 1

| Specimen | Silver halide Emulsion | Compound Kind | Compound Added Amount[1)] | humidity | ΔS storage | ΔD Remarks |
|---|---|---|---|---|---|---|
| A | A | — | — | −0.13 | +0.06 | Comparative |
| B | A | I-13 | $8.0 \times 10^{-3}$ | −0.12 | +0.05 | Comparative |
| C | A | II-12 | $8.0 \times 10^{-3}$ | −0.12 | +0.05 | Comparative |
| D | A | III-26 | $5.0 \times 10^{-3}$ | −0.11 | +0.07 | Comparative |
| E | B | — | — | −0.18 | +0.12 | Comparative |
| F | B | I-13 | $8.0 \times 10^{-3}$ | −0.05 | +0.03 | Invention |
| G | B | II-3 | $8.0 \times 10^{-3}$ | −0.04 | +0.03 | Invention |
| H | B | II-12 | $8.0 \times 10^{-3}$ | −0.05 | +0.03 | Invention |
| I | B | III-20 | $8.0 \times 10^{-3}$ | −0.05 | +0.03 | Invention |
| J | B | III-26 | $5.0 \times 10^{-3}$ | −0.03 | +0.03 | Invention |

[1)]The number of mols per mol of silver halide contained in the blue-sensitive emulsion layer
Specimens A to E are comparative while the others are according to the present invention.

Emulsion B is the same as Emulsion A except that the optimum gold sensitization was effected with chloroauric acid instead of sulfur sensitization.

The results set forth in Table 1 show that the emulsions which have been gold-sensitized (Specimen E) are disadvantageous in that they exhibit a greater desensitization upon exposure under high humidity and a greater fog density increase after prolonged storage thereof than do the emulsions which have been sulfur-sensitized. On the contrary, it can be seen that Specimens F to J comprising gold-sensitized emulsions containing a mercaptoheterocyclic compound and a compound of formula (I), (II) or (III) exhibit a reduced desensitization upon exposure under high humidity and a reduced fog density increase after prolonged storage thereof.

(Development)

The specimens which had been exposed to light were then subjected to continuous processing (running processing) in the following processing steps by means of a paper processing machine until the amount of the the replenisher reached twice the capacity of the color development tank.

| Processing step | Temperature | Time | Replenisher* | Tank capacity |
|---|---|---|---|---|
| Color development | 35° C. | 45 sec. | 161 ml | 17 l |
| Blix | 30–35° C. | 45 sec. | 215 ml | 17 l |
| Rinse 1 | 30–35° C. | 20 sec. | — | 10 l |
| Rinse 2 | 30–35° C. | 20 sec. | — | 10 l |
| Rinse 3 | 30–35° C. | 29 sec. | 350 ml | 10 l |
| Drying | 70–80° C. | 60 sec. | | |

*Replenishment rate: per $m^2$ of light-sensitive material

The rinse step was effected in a countercurrent process wherein the rinsing solution flows backward.

The various processing solutions had the following composition:

| Color Developer | Tank Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 4.0 g | 5.0 g |

-continued

| Color Developer | Tank Solution | Replenisher |
|---|---|---|
| N,N-di(sulfoethyl)hydroxylamine disodium salt | 4.0 g | 5.0 g |
| Fluorescent brightening agent (WHITEX 4B, produced by Sumitomo Chemical Co., Ltd.) | 1.0 g | 2.0 g |
| Water to make | 1,000 ml | 1,000 ml |
| pH (25° C.) | 10.05 | 10.45 |

| Blix Solution (Tank solution was used also as replenisher) | |
|---|---|
| Water | 400 ml |
| Ammonium thiosulfate (700 g/l) | 100 ml |
| Sodium sulfite | 17 g |
| Ferric ammonium ethylenediaminetetraacetate | 55 g |
| Disodium ethylenediaminetetraacetate | 5 g |
| Ammonium bromide | 40 g |
| Water to make | 1,000 ml |
| pH (25° C.) | 6.0 |

| Rinsing Solution (Tank solution was used also as replenisher) |
|---|
| Ion-exchanged water (calcium and magnesium concentration: 3 ppm each) |

EXAMPLE 2

Thirty-two g of lime-treated gelatin was dissolved in 1,000 cc of distilled water at a temperature of 40° C. Sodium chloride in the amount of 3.3 g was added to the solution which was then heated to a temperature of 70° C. To this solution was added 1.8 cc of a 1% aqueous solution of N,N'-dimethylimidazolidine-2-thione. A solution of 32.0 g of silver nitrate in 200 cc of distilled water and a solution of 11.0 g of sodium chloride in 200 cc of distilled water were then added to the solution over 14 minutes while the temperature of the system was kept at 70° C. A solution of 128.0 g of silver nitrate in 560 cc of distilled water and a solution of 44.0 g of sodium chloride in 560 cc of distilled water were then added to the solution over 40 minutes while the temperature of the system was kept at 70° C.

The material was then desalted and rinsed at a temperature of 40° C. Ninety g of lime-treated gelatin was added to the material, and sodium chloride and sodium hydroxide were then added to the material so that the pAg and pH values thereof were adjusted to 7.5 and 5.8, respectively.

The same blue-sensitive sensitizing dye as used in Example 1 was added to the material in an amount of $4\times10^{-4}$ mol per mol of silver halide. The emulsion was then subjected to optimum selenium sensitization with dimethylselenourea in an amount of $6\times10^{-6}$ mol per mol of silver halide at a temperature of 60° C. The resulting silver chloride emulsion was used later as Emulsion C.

Thirty-two g of lime-treated gelatin was dissolved in 1,000 cc of distilled water at a temperature of 40° C. Sodium chloride in the amount of 3.3 g was added to the solution which was then heated to a temperature of 70° C. To this solution was added 2.0 cc of a 1% aqueous solution of N,N'-dimethylimidazolidine-2-thione. A solution of 32 g of silver nitrate in 200 cc of distilled water and a solution of 10.9 g of sodium chloride and 0.22 g of potassium bromide in 200 cc of distilled water were then added to the solution over 15 minutes while the temperature of the system was kept at 70° C. A solution of 128.0 g of silver nitrate in 560 cc of distilled water and a solution of 43.6 g of sodium chloride and 0.90 g of potassium bromide in 560 cc of distilled water were then added to the solution over 40 minutes while the temperature of the system was kept at 70° C.

The material was then desalted and rinsed at a temperature of 40° C. Ninety g of lime-treated gelatin was added to the material, and sodium chloride and sodium hydroxide were then added to the material so that the pAg and pH values thereof were adjusted to 7.5 and 5.8, respectively.

The same blue-sensitive sensitizing dye as used in Example 1 was added to the material in an amount of $4\times10^{-4}$ mol per mol of silver halide. The emulsion was then subjected to optimum selenium sensitization with dimethylselenourea in the same amount as described above at a temperature of 60° C. The resulting silver bromochloride emulsion (silver bromide content: 1 mol %) was used later as Emulsion D.

A silver bromochloride emulsion was prepared in the same manner as Emulsion C except that an emulsion of ultrafinely divided silver bromide grains (grain size: 0.05 μm; containing potassium hexachloroiridiumate (IV)) was added to the system in an amount of 0.4 mol % as calculated in terms of silver bromide based on silver chloride. The system was then ripened for 15 minutes before optimum selenium sensitization. This emulsion was used later as Emulsion E.

Emulsions C, D, and E were then measured for grain shape, size and size distribution by electron microphotography. The grain size is represented by the average of the diameter of circles equivalent to the projected area of grains. The grain size distribution is obtained by dividing the standard deviation of grain diameters by the average grain size. Emulsions C, D, and E all comprised cubic grains with an average grain size of 0.69 μm and a grain size distribution of 0.09.

Light-sensitive materials were then prepared in the same manner as Specimen A of Example 1 except that the emulsion to be incorporated into the 1st layer (blue-sensitive layer) was replaced by the emulsions set forth in Table 2, respectively, and except that the compounds set forth in Table 2 were incorporated into the 1st layer coating solution, respectively. These light-sensitive materials were later used as Specimens a to i.

These specimens were then examined for the effect of humidity upon exposure and the fog density change after prolonged storage thereof in the same manner as in Example 1. The results are set forth in Table 2.

TABLE 2

| Specimen | Silver halide emulsion | Compound Kind | Compound Added Amount[1)] | ΔS Humidity | ΔD Storage | Remarks |
|---|---|---|---|---|---|---|
| a | C | — | — | −0.14 | +0.06 | Comparative |
| b | C | III-26 | $1.0\times10^{-2}$ | −0.05 | +0.03 | Invention |
| c | D | — | — | −0.12 | +0.05 | Comparative |
| d | D | III-26 | $1.0\times10^{-2}$ | −0.05 | +0.03 | Invention |
| e | E | — | — | −0.11 | +0.05 | Comparative |
| f | E | III-26 | $1.0\times10^{-4}$ | −0.09 | +0.04 | Invention |
| g | E | III-26 | $1.0\times10^{-3}$ | −0.04 | +0.01 | Invention |
| h | E | III-26 | $1.0\times10^{-2}$ | −0.03 | +0.00 | Invention |
| i | E | III-26 | $1.0\times10^{-1}$ | −0.04 | +0.02 | Invention |

[1)]The number of mols per mol of silver halide contained in the blue-sensitive emulsion layer The results set forth in Table 2 show that the effects of the present invention become remarkable particularly for emulsions having a high silver bromide content localized phase in the vicinity of the surface of silver halide grains.

In accordance with the present invention, a silver halide photographic material can be obtained which can undergo rapid processing, exhibit a high sensitivity and show reduced fluctuations of sensitivity due to the humidity change upon exposure and a reduced increase in the fog density even after prolonged storage thereof.

EXAMPLE 3

Thirty-two g of lime-treated gelatin was dissolved in 800 cc of distilled water at a temperature of 40° C. Sodium chloride in the amount of 5.8 g and 1.9 cc of a 1% aqueous solution of N,N'-dimethylimidazol-idine-2-thione were added to the solution which was then heated to a temperature of 72° C. A solution of 80 g of silver nitrate in 480 cc of distilled water and a solution of 27.6 g of sodium chloride in 480 cc of distilled water were then added to the solution over 60 minutes while the temperature of the system was kept at 72° C. A solution of 80 g of silver nitrate in 300 cc of distilled water and a solution of 24.3 g of sodium chloride and 4 mg of potassium hexacyanoferrate (II) trihydrate in 300 cc of distilled water were then added to the solution over 20 minutes while the temperature of the system was kept at 72° C.

The material was then desalted and rinsed at a temperature of 40° C. Ninety g of lime-treated gelatin was added to the material, and sodium chloride and sodium hydroxide were then added to the material so that the pAg and pH values thereof were adjusted to 7.4 and 6.4, respectively. The material was then heated to a temperature of 58° C.

The material was then subjected to optimum sulfur sensitization with triethylthiourea in an amount of $1\times10^{-5}$ mol per mol of silver halide. The material was then subjected to spectral sensitization with a blue-sensitive sensitizing dye of the structural formula shown below in an amount of $3\times10^{-4}$ mol per mol of silver halide. The resulting silver chloride emulsion was used later as Emulsion F.

Emulsion G was prepared in the same manner as Emulsion F except that the sulfur sensitization with triethylthiourea was replaced by selenium sensitization with dimethylselenourea in an amount of $1\times10^{-5}$ mol per mol of silver halide.

Emulsion H was prepared in the same manner as Emulsion F except that a silver bromide-localized phase was formed before sulfur sensitization by incorporating into the system an aqueous solution of potassium bromide in an amount of 0.4 mol % as calculated in terms of silver bromide based on silver chloride.

Emulsion I was prepared in the same manner as Emulsion F except that a silver bromide-localized phase was formed before sulfur sensitization by incorporating into the system an emulsion of ultrafinely divided silver bromide grains (grain size: 0.05 μm) in an amount of 0.4 mol % as calculated in terms of silver bromide based on silver chloride.

Emulsion J was prepared in the same manner as Emulsion H except that the sulfur sensitization with triethylthiourea was replaced by selenium sensitization with dimethylselenourea in an amount of $1\times10^{-5}$ mol per mol of silver halide.

Emulsion K was prepared in the same manner as Emulsion H except that the sulfur sensitization with triethylthiourea was replaced by selenium sensitization with dimethylselenourea in an amount of $1\times10^{-5}$ mol per mol of silver halide.

These six emulsions, i.e., Emulsions F to K were then measured for grain shape, size and size distribution by electron microphotography. The grain size is represented by the average of the diameter of circles equivalent to the projected area of grains. The grain size distribution is obtained by dividing the standard deviation of grain diameters by the average grain size. Emulsions F to K all comprised cubic grains having sharp corners with an average grain size of 0.8 μm and a grain size distribution of 0.08. X-ray diffraction of Emulsions H, I, J, and K showed that these emulsions have a weak diffraction in portions having a silver bromide content of 10 to 40 mol %. These results led to the conclusion that Emulsions H, I, J, and K had a localized phase having a silver bromide content of 10 to 40 mol % epitaxially grown on the corners of cubic silver chloride host grains.

A polyethylene double-laminated paper support was subjected to corona discharge. On the surface of the support was then coated a gelatin subbing layer containing sodium dodecylbenzenesulfonate. Further, various photographic constituent layers were coated on the subbing layer to prepare a multilayer color photographic paper having the following layer structure (Specimen I). The various coating solutions were prepared as follows:

Preparation of 1st layer coating solution

A yellow coupler (ExY) in the amount of 19.1 g, 4.4 g of a dye image stabilizer (Cpd-1) and 1.4 g of a dye image stabilizer (Cpd-7) were dissolved in 27.2 cc of ethyl acetate, 4.2 g of a solvent (Solv-3) and 4.2 g of a solvent (Solv-7). This solution was added to 185 cc of a 10% aqueous solution of gelatin containing 8 cc of sodium dodecylbenzenesulfonate. The mixture was then subjected to emulsion dispersion by means of an ultrasonic homogenizer. The resulting dispersion was mixed with the silver chloride Emulsion F to prepare a 1st layer coating solution.

The coating solutions for the 2nd to 7th layers were prepared in the same manner as for the 1st layer. Sodium salt of 1-oxy-3,5-dichloro-s-triazine was used as a gelatin hardener for each layer.

To each of these layers were added Cpd-10 and Cpd-11 in amounts of 25.0 mg/m$^2$ and 50.0 mg/m$^2$, respectively.

The spectral sensitizing dyes incorporated into the silver bromochloride emulsion in these light-sensitive emulsion layers were the following spectral sensitizing dyes:

Sensitizing Dye A for blue-sensitive emulsion layer (as used in Example 1)

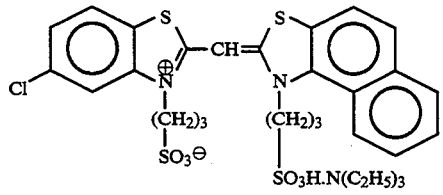

Sensitizing Dye B for blue-sensitive emulsion layer

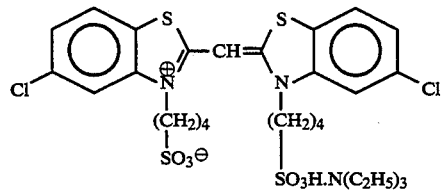

($1.5\times10^{-4}$ mol each per mol of silver halide based on Emulsion F)

Sensitizing Dye C for green-sensitive emulsion layer (same as used in Example 1)

($4.0\times10^{-4}$ mol per mol of silver halide for large size emulsion, $5.6\times10^{-4}$ mol per mol of silver halide for small size emulsion)

Sensitizing Dye D for green-sensitive emulsion layer (same as used in Example 1)

($7.0\times10^{-5}$ mol per mol of silver halide for large size emulsion, $1.0\times10^{-5}$ mol per mol of silver halide for small size emulsion)

Sensitizing Dye E for red-sensitive emulsion layer (same as used in Example 1)

($0.9\times10^{-4}$ mol per mol of silver halide for large size emulsion, $1.1\times10^{-4}$ mol per mol of silver halide for small size emulsion)

To the red-sensitive emulsion layer was added the following compound in an amount of $2.6\times10^{-3}$ mol per mol of silver halide:

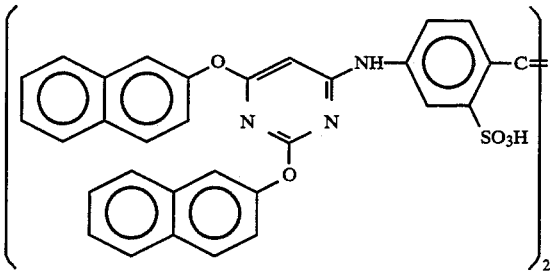

For the purpose of inhibiting irradiation, to the emulsion layer were added the same dyes as used in Example 1.

(Layer Arrangement)

The composition of the various layers are set forth below. The figure indicates the coated amount (g/m$^2$). The coated amount of silver halide emulsion is represented as calculated in terms of silver.

| | |
|---|---|
| Support: | |
| Polyethylene-laminated paper [containing a white pigment ($TiO_2$) and a bluish dye (ultramarine) in polyethylene on the 1st layer side] | |
| 1st Layer (blue-sensitive yellow coloring layer): | |
| Silver chloride Emulsion F (as described above) | 0.30 |
| Gelatin | 1.22 |
| Yellow Coupler (ExY) | 0.82 |
| Dye Image Stabilizer (Cpd-1) | 0.19 |
| Solvent (Solv-3) | 0.18 |
| Solvent (Solv-7) | 0.18 |
| Dye Image Stabilizer (Cpd-7) | 0.06 |
| 2nd Layer (color stain inhibiting layer): | |
| Gelatin | 0.64 |
| Color Stain Inhibitor (Cpd-5) | 0.10 |
| Solvent (Solv-1) | 0.16 |
| Solvent (Solv-4) | 0.08 |
| 3rd Layer (green-sensitive magenta coloring layer): | |
| Silver bromochloride emulsion (1:3 (Ag molar ratio) of a large size emulsion comprising cubic grains with an average size of 0.55 μm and a grain size fluctuation coefficient of 0.10 and a small size emulsion comprising cubic grains with an average size of 0.39 μm and a grain size fluctuation coefficient of 0.08; both emulsions comprising 0.8 mol % of AgBr localized partially on the surface of grains) | 0.12 |
| Gelatin | 1.28 |
| Magenta Coupler (ExM) | 0.23 |
| Dye Image Stabilizer (Cpd-2) | 0.03 |
| Dye Image Stabilizer (Cpd-3) | 0.16 |
| Dye Image Stabilizer (Cpd-4) | 0.02 |
| Dye Image Stabilizer (Cpd-9) | 0.02 |
| Solvent (Solv-2) | 0.40 |
| 4th Layer (ultraviolet absorbing layer): | |
| Gelatin | 1.41 |
| Ultraviolet Absorbent (UV-1) | 0.47 |
| Color Stain Inhibitor (Cpd-5) | 0.05 |
| Solvent (Solv-5) | 0.24 |
| 5th Layer (red-sensitive cyan coloring layer): | |
| Silver bromochloride emulsion (1:4 (Ag molar ratio) of a large size emulsion comprising cubic grains with an average size of 0.58 μm and a grain size fluctuation coefficient of 0.09 and a small size emulsion comprising cubic grains with an average size of 0.45 μm and a grain size fluctuation coefficient of 0.11; both emulsions comprising 0.6 mol % of AgBr localized partially on the surface of grains) | 0.23 |
| Gelatin | 1.04 |
| Cyan Coupler (ExC) | 0.32 |
| Dye Image Stabilizer (Cpd-2) | 0.03 |
| Dye Image Stabilizer (Cpd-4) | 0.02 |
| Dye Image Stabilizer (Cpd-6) | 0.18 |
| Dye Image Stabilizer (Cpd-7) | 0.40 |
| Dye Image Stabilizer (Cpd-8) | 0.05 |
| Solvent (Solv-6) | 0.14 |
| 6th Layer (ultraviolet absorbing layer): | |
| Gelatin | 0.48 |
| Ultraviolet Absorbent (UV-1) | 0.16 |
| Color Stain Inhibitor (Cpd-5) | 0.02 |
| Solvent (Solv-5) | 0.08 |
| 7th Layer (protective layer): | |
| Gelatin | 1.10 |
| acryl-modified copolymer of polyvinyl alcohol (modification degree: 17%) | 0.17 |
| Liquid paraffin | 0.03 |

The couplers, dye image stabilizers, solvents, ultraviolet absorbents and color stain inhibitors used in Example 3 are set forth in Example 1.

Specimens 2 to 6 were prepared in the same manner as the light-sensitive material thus obtained except that the emulsion to be incorporated in the blue-sensitive layer was replaced by the emulsions set forth in Table 3, respectively.

In order to examine these 6 specimens for sensitivity and gradation, they were exposed to light through an optical wedge and a blue filter for 10 seconds or $10^{-2}$ seconds. After about 1 hour, these specimens were then subjected to color development with the processing solutions described later in the processing steps described later.

In order to examine these specimens for latent image preservability, they were exposed to light through an optical wedge and a blue filter for $10^{-2}$ seconds. After 10 seconds and 10 minutes, these specimens were subjected to color development with the processing solutions described later in the processing steps described later.

The specimens thus processed were measured for reflective density from which the characteristic curves were then obtained. The sensitivity is represented by the reciprocal of the exposure required to give a density 0.5 higher than fog density, relative to that of Specimen 1 which has been exposed to light for 10 seconds as 100. The gradation is represented by the difference between the density for the exposure 0.5 higher in log E than the exposure at which the sensitivity is determined and the density at which the sensitivity is determined.

For the evaluation of latent image preservability, the difference in density between the specimen which had been processed 10 seconds after exposure and the specimen which had been processed 10 minutes after exposure was determined. For the evaluation of density difference, the specimens which had been processed 10 minutes after exposure were measured for density at the exposure required to give a density 0.5 higher than fog density with the specimens which had been processed 10 seconds after exposure. The density difference is represented by the difference of the density thus obtained from those obtained with the specimens which had been processed 10 seconds after exposure. If this value is positive, it means latent image sensitization. If this value is negative, it means regression of the latent image. The results are set forth in Table 4.

TABLE 3

| Specimen | Emulsion for blue-sensitive layer | Presence of silver bromide localized phase | Chemical sensitization | Remarks |
|---|---|---|---|---|
| Specimen 1 | Emulsion F | No | S | Comparative |
| Specimen 2 | Emulsion G | No | Se | " |
| Specimen 3 | Emulsion H | Yes | S | " |
| Specimen 4 | Emulsion I | Yes | S | " |
| Specimen 5 | Emulsion J | Yes | Se | Invention |
| Specimen 6 | Emulsion K | Yes | Se | " |

TABLE 4

| | 10 second exposure | | $10^{-2}$ second exposure | | Latent image preservability* | Remarks |
|---|---|---|---|---|---|---|
| | Sensitivity | Gradation | Sensitivity | Gradation | | |
| Specimen 1 | 100 | 1.3 | 50 | 0.5 | +0.1 | Comparative |
| Specimen 2 | 100 | 1.3 | 54 | 0.6 | +0.09 | " |
| Specimen 3 | 150 | 1.25 | 74 | 0.45 | +0.11 | " |
| Specimen 4 | 170 | 1.31 | 85 | 0.5 | +0.1 | " |
| Specimen 5 | 150 | 1.25 | 95 | 0.8 | +0.05 | Invention |
| Specimen 6 | 170 | 1.31 | 120 | 0.9 | +0.04 | " |

*+(plus) indicates latent image sensitization, and −(minus) indicates the regression of latent image. The smaller this value is, the better is the latent image preservability.

(Development)

The specimens which had been exposed to light were then subjected to continuous processing (running processing) in the same processing steps as used in Example 1 by means of a paper processing machine until the replenishment reached twice the capacity of the color development tank.

The composition of the various processing solutions was the same as used in Example 1.

The results set forth in Table 4 show that the effects of the present invention are evident. That is, Specimens 1 and 2, which comprised the pure silver chloride emulsions F and G, respectively, cannot provide sufficient sensitivity and thus cannot be put into practical use.

Specimens 3 and 4, which comprise sulfur-sensitized Emulsions H and I having a silver bromide localized phase, respectively, can provide a high sensitivity but exhibit desensitization and decrease in contrast upon exposure for a short period of time at a high intensity and a poor latent image preservability. Only Specimens 5 and 6, which comprise selenium-sensitized Emulsions J and K having a silver bromide localized phase, respectively, can provide a silver halide photographic material which exhibits a high sensitivity, a reduced sensitivity and gradation fluctuations due to the change in exposure time and an excellent latent image preservability.

EXAMPLE 4

Emulsion L was prepared in the same manner as Emulsion I of Example 3 except that potassium hexachloroiridiumate (IV) was incorporated into the system during the formation of finely divided silver bromide grains so that iridium salts were incorporated in the localized phase formed by the addition of finely divided silver bromide grains in an amount of $1\times10^{-7}$ mol per mol of silver halide.

Emulsion M was prepared in the same manner as Emulsion K of Example 3 except that potassium hexachloroiridiumate (IV) was incorporated into the system during the formation of finely divided silver bromide grains so that iridium salts were incorporated in the localized phase formed by the addition of finely divided silver bromide grains in an amount of $1\times10^{-7}$ mol per mol of silver halide.

Emulsion N was prepared in the same manner as Emulsion L except that the iridium salt content was $2\times10^{-5}$ mol per mol of silver halide.

Emulsion O was prepared in the same manner as Emulsion M except that the iridium salt content was $2\times10^{-5}$ mol per mol of silver halide.

Multilayer color photographic paper specimens 7 to 10 were then prepared from Emulsions L to O thus obtained in the same manner as in Example 3 (see Table 10). Together with Specimens 4 and 6 of Example 3, these specimens were exposed to light, developed, and then evaluated for photographic properties in the same manner as in Example 3. The results are set forth in Table 6.

TABLE 5

| Specimen | Emulsion for blue-sensitive layer | Presence of silver bromide localized phase | Chemical sensitization | Ir content (per mol of SiX) |
|---|---|---|---|---|
| Specimen 4 | Emulsion I | Yes | S | — |
| Specimen 6 | Emulsion K | " | Se | — |
| Specimen 7 | Emulsion L | " | S | $1\times10^{-7}$ mol |
| Specimen 8 | Emulsion M | " | Se | " |
| Specimen 9 | Emulsion N | " | S | $2\times10^{-5}$ mol |
| Specimen 10 | Emulsion O | " | Se | " |

TABLE 6

| | 10 second exposure | | $10^{-2}$ second exposure | | Latent image preservability* |
|---|---|---|---|---|---|
| | Sensitivity | Gradation | Sensitivity | Gradation | |
| Specimen 4 | 170 | 1.35 | 85 | 0.5 | +0.1 |
| Specimen 6 | 170 | 1.35 | 120 | 0.9 | +0.04 |
| Specimen 7 | 175 | 1.35 | 115 | 0.8 | +0.1 |
| Specimen 8 | 175 | 1.35 | 160 | 1.35 | +0.03 |
| Specimen 9 | 160 | 1.35 | 155 | 1.30 | +0.18 |
| Specimen 10 | 160 | 1.35 | 155 | 1.35 | +0.06 |

Note) Specimens 4, 7 and 9 are comparative while the others are according to the present invention.
*Represented relative to the sensitivity of Specimen 1 of Example 3 which has been exposed to light for 10 seconds as 100

The results set forth in Table 6 show that the effects of the present invention are evident. That is, Specimen 7, which comprises a sulfur-sensitized Emulsion L, having an iridium-containing localized phase (iridium content: $1\times10^{-7}$ mol per mol of silver halide), exhibits reduced desensitization and a decrease in contrast upon exposure for a short period of time at a high intensity as compared with Specimen 4, which has no iridium content, but leaves much to be desired and shows no improvement in the latent image preservability. Specimen 9, which comprises an increased iridium salt content, exhibits little or no desensitization and decrease in contrast upon exposure for a short period of time at a high intensity as compared with Specimen 7, but shows a poorer latent image preservability. Thus, these specimens cannot be put into practical use.

On the other hand, Specimen 8, which comprises a selenium-sensitized emulsion having an iridium content of $1\times10^{-7}$ mol/mol Ag, can exhibit reduced sensitivity and gradation fluctuations due to a change in the exposure time while maintaining an excellent latent image preservability. Further, Specimen 10, which comprises an increased iridium salt content, exhibits an excellent latent image preservability as compared with Specimen 9, which comprises a sulfur-sensitized emulsion, and thus can exhibit reduced sensitivity and gradation fluctuations due to the change in the exposure time while maintaining an excellent latent image preservability.

In accordance with the present invention, a silver halide photographic material can be obtained which can undergo rapid processing, exhibits a high sensitivity and shows reduced fluctuations of sensitivity and gradation due to a change in the exposure time while maintaining an excellent latent image preservability.

EXAMPLE 5

Thirty-two g of lime-treated gelatin was dissolved in 800 cc of distilled water at a temperature of 40° C. Sodium chloride in the amount of 5.76 g was added to the solution which was then heated to a temperature of 70° C. To this solution was added 1.0 cc of a 1% aqueous solution of N,N'-dimethylimidazolidine-2-thione. A solution of 100 g of silver nitrate in 400 cc of distilled water and a solution of 34.4 g of sodium chloride in 400 cc of distilled water were then added to the solution over 53 minutes while the temperature of the system was kept at 70° C. A solution of 60 g of silver nitrate in 200 cc of distilled water and a solution of 17.4 g of sodium chloride in 200 cc of distilled water were then added to the solution over 18 minutes while the temperature of the system was kept at 70° C.

The material was then desalted and rinsed at a temperature of 40° C. Ninety g of lime-treated gelatin was added to the material, and sodium chloride and sodium hydroxide were then added to the material so that the pAg and pH values thereof were adjusted to 7.3 and 6.7, respectively. The material was then heated to a temperature of 55° C.

The same blue-sensitive sensitizing dye as used in Example 1 was added to the material in an amount of $4\times10^{-4}$ mol per mol of silver halide. The emulsion was then subjected to optimum sulfur sensitization with triethylthiourea. The resulting silver chloride emulsion was used later as Emulsion P.

Thirty-two g of lime-treated gelatin was dissolved in 800 cc of distilled water at a temperature of 40° C. Sodium chloride in the amount of 5.76 g was added to the solution which was then heated to a temperature of 70° C. To this solution was added 1.0 cc of a 1% aqueous solution of N,N'-dimethylimidazolidine-2-thione. A solution of 100 g of silver nitrate in 400 cc of distilled water and a solution of 34.4 g of sodium chloride in 400 cc of distilled water were then added to the solution over 53 minutes while the temperature of the system was kept at 70° C. A solution of 59.2 g of silver nitrate in 200 cc of distilled water and a solution of 17.1 g of sodium chloride in 200 cc of distilled water were then added to the solution over 18 minutes while the temperature of the system was kept at 70° C. The material was then allowed to cool to a temperature of 40° C.

To the material was then added the same blue-sensitive sensitizing dye as used in Example 1 in an amount of $4\times10^{-4}$ mol per mol of silver halide. A solution of 0.8 g of silver nitrate in 100 cc of distilled water and a solution of 0.56 g of potassium bromide in 100 cc of distilled water were added to the material over 10 minutes while the system was kept at a temperature of 40° C. The material was then desalted and rinsed.

Ninety g of lime-treated gelatin was added to the material, and sodium chloride and sodium hydroxide were then added to the material so that the pAg and pH values thereof were adjusted to 7.3 and 6.7, respectively. The material was then heated to a temperature of 55° C. The emulsion was then subjected to optimum sulfur sensitization with triethylthiourea. The resulting silver bromochloride emulsion (silver bromide content: 0.5 mol %) was used later as Emulsion Q.

A silver bromochloride emulsion (silver bromide content: 0.5 mol %) was prepared in the same manner as Emulsion Q except that the potassium bromide solution comprised potassium hexachloroiridiumate (IV) incorporated therein in an amount of $7.0\times10^{-6}$ per mol of silver nitrate to be incorporated at the same time.

Emulsions P, Q, and R were then measured for grain shape, size and size distribution by electron microphotography in the same manner as in Example 1. Emulsions P, Q, and R all comprised cubic grains with an average grain size of 0.70 μm and a grain size distribution of 0.10. The electron microphotograph of Emulsions Q and R revealed that the cubic grains contained in Emulsions Q and R have sharper corners than those contained in Emulsion P. X-ray diffraction of Emulsions Q and R showed that these emulsions have a weak diffraction in portions having a silver bromide content of 10 to 40 mol %. These results led to the conclusion that Emulsions Q and R had a localized phase having a silver bromide content of 10 to 40 mol % epitaxially grown on the corners of cubic silver chloride host grains.

Specimen A' was prepared in the same manner as Specimen A in Table 1 except that Emulsion P thus obtained was used as the emulsion for the 1st layer and the coated amount of components were altered as set forth below.

| | Coated amount (g/m$^2$) |
|---|---|
| 1st Layer: | |
| Gelatin | 1.86 |
| 2nd Layer: | |
| Gelatin | 0.99 |
| Color stain inhibitor (Cpd-5) | 0.08 |
| 3rd Layer: | |
| Gelatin | 1.24 |
| 4th Layer: | |
| Gelatin | 1.58 |
| 5th Layer: | |
| Gelatin | 1.34 |
| 6th Layer: | |
| Gelatin | 0.53 |

-continued

| | Coated amount (g/m²) |
|---|---|
| 7th Layer: | |
| Gelatin | 1.33 |

Specimens B' to S' were prepared in the same manner as Specimen A' thus obtained except that the emulsion incorporated into the 1st layer (blue-sensitive layer) was altered as set forth in Table 7 and compounds set forth in Table 7 were incorporated into the 1st layer coating solution, respectively.

In order to examine the sensitivity of the light-sensitive materials and the fluctuations of the photographic sensitivity due to a change in the humidity upon exposure, the light-sensitive materials were stored in an atmosphere of 25° C.-55% RH and 25° C.-85% RH where they were exposed to light through an optical wedge and a blue filter for 5 seconds. These light-sensitive materials were then subjected to color development with the processing solutions described later in the processing steps described later. The sensitivity change (ΔS humidity) is represented by the difference in the logarithm of the exposure required to give a density 1.0 higher than fog density. If this value is negative, it means desensitization upon exposure under a high humidity.

In order to examine the sensitivity change due to fluctuations of the time interval between exposure and processing, these specimens were exposed to light through an optical wedge and a blue filter for 5 seconds. After 10 minutes and after 3 hours in an atmosphere of 35° C.-40% RH, these specimens were then subjected to color development with the processing solutions described later in the processing steps described later. The sensitivity change (ΔS latent image) is represented by the difference in the logarithm of the exposure required to give a density 1.0 higher than fog density. If this value is positive, it means sensitization with time after exposure.

For the evaluation of the change in the photographic properties after prolonged storage, these specimens were stored in an atmosphere of 50° C.-40% RH for 2 days, and then subjected to exposure and processing in the same manner as described above. These specimens were then measured for the sensitivity change (ΔS storage) from the specimen which had not been stored in the foregoing atmosphere.

The results are set forth in Table 7.

TABLE 7

| Specimen | Silver halide Emulsion | Kind of Compound | Added Amount[1)] | ΔS latent image | ΔS humidity | ΔD storage |
|---|---|---|---|---|---|---|
| A' | P | — | — | +0.06 | −0.14 | +0.12 |
| B' | P | I-16 | $1.8 \times 10^{-2}$ | +0.05 | −0.14 | +0.11 |
| C' | P | II-15 | $1.8 \times 10^{-2}$ | +0.05 | −0.14 | +0.10 |
| D' | P | III-26 | $9.0 \times 10^{-3}$ | +0.05 | −0.13 | +0.11 |
| E' | Q | — | — | +0.08 | −0.10 | +0.14 |
| F' | Q | I-16 | $1.8 \times 10^{-2}$ | +0.03 | −0.06 | +0.03 |
| G' | Q | II-15 | $1.8 \times 10^{-2}$ | +0.02 | −0.07 | +0.02 |
| H' | Q | III-26 | $9.0 \times 10^{-3}$ | +0.02 | −0.06 | +0.03 |
| I' | R | — | — | +0.06 | −0.09 | +0.13 |
| J' | R | I-13 | $1.8 \times 10^{-2}$ | +0.02 | −0.02 | +0.03 |
| K' | R | I-16 | $1.8 \times 10^{-2}$ | +0.02 | −0.02 | +0.02 |
| L' | R | II-2 | $1.8 \times 10^{-2}$ | +0.02 | −0.02 | +0.03 |
| M' | R | II-6 | $1.8 \times 10^{-2}$ | +0.02 | −0.03 | +0.04 |
| N' | R | II-13 | $1.8 \times 10^{-2}$ | +0.03 | −0.02 | +0.03 |
| O' | R | II-15 | $1.8 \times 10^{-2}$ | +0.02 | −0.03 | +0.03 |
| P' | R | III-15 | $1.8 \times 10^{-2}$ | +0.01 | −0.02 | +0.01 |
| Q' | R | III-20 | $1.8 \times 10^{-2}$ | +0.00 | −0.02 | +0.02 |
| R' | R | III-26 | $9.0 \times 10^{-3}$ | +0.00 | −0.01 | +0.01 |
| S' | R | III-27 | $9.0 \times 10^{-3}$ | +0.00 | −0.01 | +0.01 |

[1)]Represented by the molar amount added per mol of silver halide contained in the blue-sensitive emulsion layer
Specimens A' to E' and I' are comparative while the others are according to the present invention.

(Development)

The specimens which had been exposed to light were then subjected to continuous processing (running processing) in the same processing steps as used in Example 1 by means of a paper processing machine until the replenishment reached twice the capacity of the color development tank.

The composition of the various processing solutions was the same as used in Example 1.

The results set forth in Table 7 show that the sensitivity change of a specimen comprising a high silver content emulsion having a high silver bromide content localized phase due to fluctuations of humidity upon exposure and fluctuations of the time interval between exposure and processing and after prolonged storage of the light-sensitive material can be remarkably reduced by incorporating a compound of formula (I), (II) or (III) into the light-sensitive material. These effects become remarkable, particularly for Specimens J' to S' comprising a silver halide emulsion containing iridium (Emulsion R).

EXAMPLE 6

Thirty-two g of lime-treated gelatin was dissolved in 1,000 cc of distilled water at a temperature of 40° C. Sodium chloride in an amount of 3.3 g was added to the solution which was then heated to a temperature of 70° C. To this solution was then added 1.2 cc of a 1% aqueous solution of N,N'-dimethylimid-azolidine-2-thione. A solution of 32.0 g of silver nitrate in 200 cc of distilled water and a solution of 11.0 g of sodium chloride in 200 cc of distilled water were then added to the solution over 14 minutes while the temperature of the system was kept at 74° C. A solution of 128.0 g of silver nitrate in 560 cc of distilled water and a solution of 44.0 g of sodium chloride in 560 cc of distilled water were then added to the solution over 40 minutes while the temperature of the system was kept at 74° C.

The material was then desalted and rinsed at a temperature of 40° C. Ninety g of lime-treated gelatin was added to the material, and sodium chloride and sodium hydroxide were then added to the material so that the pAg and pH values thereof were adjusted to 7.5 and 6.8, respectively.

The same blue-sensitive sensitizing dye as used in Example 1 was added to the material in an amount of $3.5\times10^{-4}$ mol per mol of silver halide. The emulsion was then subjected to optimum sulfur sensitization with triethylthiourea. The resulting silver chloride emulsion was used later as Emulsion S.

Thirty-two g of lime-treated gelatin was dissolved in 1,000 cc of distilled water at a temperature of 40° C. Sodium chloride in an amount of 3.3 g was added to the solution which was then heated to a temperature of 74° C. To this solution was then added 1.6 cc of a 1% aqueous solution of N,N'-dimethylimid-azolidine-2-thione. A solution of 32.0 g of silver nitrate in 200 cc of distilled water and a solution of 10.9 g of sodium chloride and 0.22 g of potassium bromide in 200 cc of distilled water were then added to the solution over 15 minutes while the temperature of the system was kept at 74° C. A solution of 128.0 g of silver nitrate in 560 cc of distilled water and a solution of 43.6 g of sodium chloride and 0.90 g of potassium bromide in 560 cc of distilled water were then added to the solution over 40 minutes while the temperature of the system was kept at 74° C.

The material was then desalted and rinsed at a temperature of 40° C. Ninety g of lime-treated gelatin was added to the material, and sodium chloride and sodium hydroxide were added to the material so that the pAg and pH values thereof were adjusted to 7.5 and 6.8, respectively.

The same blue-sensitive sensitizing dye as used in Example 1 was added to the material in an amount of $3.5\times10^{-4}$ mol per mol of silver halide. The emulsion was then subjected to optimum sulfur sensitization with triethylthiourea at a temperature of 65° C. The resulting silver bromochloride emulsion (silver bromide content: 1 mol %) was used later as Emulsion T.

A silver bromochloride emulsion was prepared in the same manner as Emulsion S except that an emulsion of ultrafinely divided silver bromide grains (grain size: 0.05 μm; containing potassium hexachloroiridiumate (IV) in an amount of $6.0\times10^{-6}$ mol per mol of silver bromide) was added to the system in an amount of 0.4 mol % as calculated in terms of silver bromide based on silver chloride and the system was then ripened at a temperature of 65° C. for 15 minutes before the optimum sulfur sensitization. This emulsion was used later as Emulsion U.

Emulsions S, T, and U were then measured for grain shape, size and size distribution by electron microphotography in the same manner as in Example 1. Emulsions S, T, and U all comprised cubic grains with an average grain size of 0.71 μm and a grain size distribution of 0.09.

Specimens a' to i' were prepared in the same manner as Specimen A' of Example 5 except that the emulsion to be incorporated into the 1st layer (blue-sensitive layer) was replaced by the emulsions set forth in Table 8 and the compounds set forth in Table 8 were incorporated into the 1st layer coating solution.

These specimens were then examined for the effects of humidity upon exposure and time fluctuations between exposure and processing and the sensitivity change after prolonged storage thereof as in Example 5. The results are set forth in Table 8.

TABLE 8

| Specimen | Silver halide Emulsion | Kind of Compound | Added Amount[1)] | ΔS latent image | ΔS humidity | ΔD storage |
|---|---|---|---|---|---|---|
| a' | S | — | — | +0.05 | −0.13 | +0.10 |
| b' | S | III-26 | $1.0\times10^{-2}$ | +0.04 | −0.13 | +0.09 |
| c' | T | — | — | −0.05 | −0.14 | +0.10 |
| d' | T | III-26 | $1.0\times10^{-2}$ | +0.04 | −0.14 | +0.09 |
| e' | U | — | — | +0.05 | −0.10 | +0.10 |
| f' | U | III-26 | $1.0\times10^{-4}$ | +0.03 | −0.07 | +0.05 |
| g' | U | III-26 | $1.0\times10^{-3}$ | +0.01 | −0.05 | +0.03 |
| h' | U | III-26 | $1.0\times10^{-2}$ | +0.00 | −0.02 | +0.02 |
| i' | U | III-26 | $1.0\times10^{-1}$ | +0.01 | −0.01 | +0.02 |

[1)]Represented by the molar amount added per mol of silver halide contained in the blue-sensitive emulsion layer.
Specimens a' to e' are comparative while the others are according to the present invention.

The results in Table 8 show that the effects of the present invention are particularly remarkable for Specimens f' to i' comprising Emulsion U having a high silver bromide content localized phase near the surface of silver halide grain.

In accordance with the present invention, a silver halide photographic material can be obtained which can undergo a rapid processing and exhibit a high sensitivity, a reduced sensitivity change due to fluctuations of humidity upon exposure and fluctuations of the time interval between exposure and processing and a reduced sensitivity change even after prolonged storage thereof.

While the invention has been described in detailed and with reference to specific embodiments thereof, it will be apparent to one skilled in the art that various changes and modifications can be made therein without departing from the spirit and scope thereof.

What is claimed is:

1. A silver halide photographic material comprising at least one light-sensitive emulsion layer containing a silver halide emulsion on a support, said light-sensitive emulsion layer comprising (a) a silver halide emulsion chemically sensitized with a selenium compound and containing silver halide grains having a silver chloride content of 90 mol % or more and (b) at least one compound represented by formula (I) or (II):

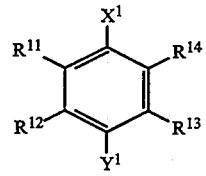

(I)

wherein $X^1$ represents $—NR^{15}R^{16}$ or $—NHSO_2R^{17}$; $Y^1$ represents a hydroxyl group or has the same meaning as $X^1$; $R^{11}$, $R^{12}$, $R^{13}$ and $R^{14}$ each represents a hydrogen atom or any substituent; $R^{11}$ and $R^{12}$, and $R^{13}$ and $R^{14}$ may together form a carbon ring; $R^{15}$ and $R^{16}$ each represents a hydrogen atom, an alkyl, aryl or heterocyclic group; $R^{15}$ and $R^{16}$ each represents may together form a nitrogen-containing heterocyclic group; and $R^{17}$ represents an alkyl, amino or heterocyclic group;

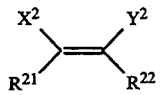

(II)

wherein $X^2$ and $Y^2$ each represents a hydroxyl group, $—NR^{23}R^{24}$ or $—NHSO_2R^{25}$; $R^{21}$ and $R^{22}$ and each represents a hydrogen atom or any substituent; $R^{21}$ and $R^{22}$ may together form a heterocyclic group, which group is unsubstituted or is substituted by a substituent which is a member selected from the group consisting of an alkyl group, an aryl group, an alkoxy group, an acyl group, a carbamoyl group, an alkoxycarbonyl group, a hydroxyl group, a halogen atom, a cyano group, a nitro group, a sulfo group and a carboxyl group; $R^{23}$ and $R^{24}$ each represents a hydrogen atom, an alkyl, aryl or heterocyclic group; $R^{23}$ and $R^{24}$ may together form a nitrogen-containing heterocyclic group; and $R^{25}$ represents an alkyl, aryl, amino or heterocyclic group.

2. A silver halide photographic material as claimed in claim 1, which comprises a substantially silver iodide-free silver bromochloride emulsion having a silver chloride content of 95 mol % or more and a silver bromide localized phase in the vicinity of the surface of silver halide grains contained in the silver halide emulsion in an amount of more than 10 mol % as calculated in terms of silver bromide content.

3. A silver halide photographic material as in claim 1, which comprises a compound represented by formula (II) in which $R^{21}$ and $R^{22}$ together form a heterocyclic ring, which ring is unsubstituted or substituted by a substituent which is a member selected from the group consisting of an alkyl group, an aryl group, an alkoxy group, an acyl group, a carbamoyl group, an alkoxycarbonyl group, a hydroxyl group, a halogen atom, a cyano group, a nitro group, a sulfo group and a carboxyl group.

4. A silver halide photographic material as claimed in claim 1, wherein said light-sensitive emulsion layer containing said silver halide emulsion further comprises at least one mercaptoheterocyclic compound represented by formula (a), (b) or (c):

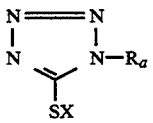

(a)

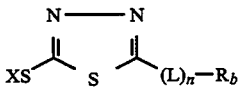

(b)

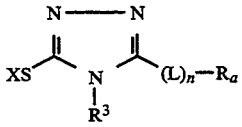

(c)

wherein $R_a$ represents an alkyl, alkenyl, or aryl group; X represents a hydrogen atom, an alkali metal atom, an ammonium group or a precursor thereof; $R_b$ represents a hydrogen atom or $R_a$; L represents a divalent linking group; n represents an integer 0 or 1; $R^3$ has the same meaning as $R_a$; and $R^3$ and $R_a$ may be the same or different.

5. A silver halide photographic material comprising at least one light-sensitive emulsion layer containing a silver halide emulsion on a support, said light-sensitive emulsion layer comprising (a) a silver halide emulsion chemically sensitized with a gold compound and containing silver halide grains having a silver chloride content of 90 mol % or more and (b) at least one compound represented by formula (I) or (II):

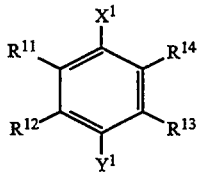

(I)

wherein $X^1$ represents $—NR^{15}R^{16}$ or $—NHSO_2R^{17}$; $Y^1$ represents a hydroxyl group or has the same meaning as $X^1$; $R^{11}$, $R^{12}$, $R^{13}$, and $R^{14}$ each represents a hydrogen atom, an alkyl group, an aryl group, an amino group, an amido group, an alkoxy group, an alkylthio group, an acyl group, a carbamoyl group, an alkoxycarbonyl group, a halogen atom, a cyano group, a nitro group, a sulfo group, or a carboxyl group; $R^{11}$ and $R^{12}$, and $R^{13}$ and $R^{14}$ may together form a carbon ring; $R^{15}$ and $R^{16}$ each represents a hydrogen atom, an alkyl, aryl or heterocyclic group; $R^{15}$ and $R^{16}$ may together form a nitrogen-containing heterocyclic group; and $R^{17}$ represents an alkyl, amino or heterocyclic group;

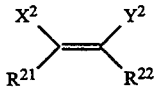

(II)

wherein $X^2$ and $Y^2$ each represents a hydroxyl group or $—NR^{23}R^{24}$; $R^{21}$ and $R^{22}$ each represents a hydrogen atom or any substituent; $R^{21}$ and $R^{22}$ may together form a heterocyclic group, which group is unsubstituted or is substituted by a substituent which is a member selected from the group consisting of an alkyl group, an aryl group, an alkoxy group, an acyl group, a carbamoyl group, an alkoxycarbonyl group, a hydroxyl group, a halogen atom, a cyano group, a nitro group, a sulfo group and a carboxyl group; $R^{23}$ and $R^{24}$ each represents a hydrogen atom, an alkyl, aryl or heterocyclic group; and $R^{23}$ and $R^{24}$ may together form a nitrogen-containing heterocyclic group.

6. A silver halide photographic material as claimed in claim 5, wherein said light-sensitive emulsion layer containing said silver halide emulsion chemically sensitized with said gold compound further comprises at least one mercaptoheterocyclic compound represented by formula (a), (b) or (c):

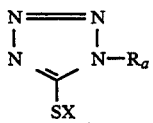

(a)

-continued

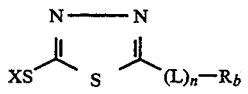

(b)

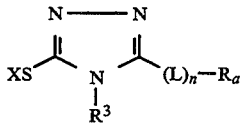

(c)

wherein $R_a$ represents an alkyl, alkenyl or aryl group; X represents a hydrogen atom, an alkali metal atom, an ammonium group or a precursor thereof; $R_b$ represents a hydrogen atom or $R_a$; L represents a divalent linking group; n represents an integer 0 or 1; $R^3$ has the same meaning as $R_a$; and $R^3$ and $R_a$ may be the same or different.

7. A silver halide photographic material as in claim 5, which comprises a compound represented by formula (II) in which $R^{21}$ and $R^{22}$ together form a heterocyclic ring, which ring may be substituted by a substituent which is a member selected from the group consisting of an alkyl group, an aryl group, an alkoxy group, an acyl group, a carbamoyl group, an alkoxycarbonyl group, a hydroxyl group, a halogen atom, a cyano group, a nitro group, a sulfo group and a carboxyl group.

8. A silver halide photographic material comprising at least one light-sensitive emulsion layer containing a silver halide emulsion on a support, said light-sensitive emulsion layer comprising (a) a substantially silver iodide-free silver bromochloride emulsion having a localized phase with a silver bromide content of 10% or more in the vicinity of the surface of silver halide grains, the silver chloride content of said grains being 95 mol % or more and (b) at least one compound represented by formula (I) or (II):

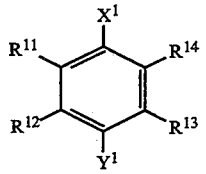

(I)

wherein $X^1$ represents $—NR^{15}R^{16}$ or $—NHSO_2R^{17}$; $Y^1$ represents a hydroxyl group or has the same meaning as $X^1$; $R^{11}$, $R^{12}$, $R^{13}$ and $R^{14}$ each represents a hydrogen atom or any substituent; $R^{11}$ and $R^{12}$, and $R^{13}$ and $R^{14}$ may together form a carbon ring; $R^{15}$ and $R^{16}$ each represents a hydrogen atom, an alkyl, aryl or heterocyclic group; $R^{15}$ and $R^{16}$ may together form a nitrogen-containing heterocyclic group; and $R^{17}$ represents an alkyl, amino or heterocyclic group;

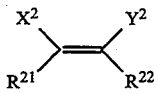

(II)

wherein $X^2$ and $Y^2$ each represents a hydroxyl group, $—NR^{23}R^{24}$ or $—NHSO_2R^{25}$; $R^{21}$ and $R^{22}$ each represents a hydrogen atom or any substituent; $R^{21}$ and $R^{22}$ may together form a heterocyclic group, which group is unsubstituted or is substituted by a substituent which is a member selected from the group consisting of an alkyl group, an aryl group, an alkoxy group, an acyl group, a carbamoyl group, an alkoxycarbonyl group, a hydroxyl group, a halogen atom, a cyano group, a nitro group, a sulfo group and a carboxyl group; $R^{23}$ and $R^{24}$ each represents a hydrogen atom, an alkyl, aryl or heterocyclic group; $R^{23}$ and $R^{24}$ may together form a nitrogen-containing heterocyclic group; and $R^{25}$ represents an alkyl, aryl, amino or heterocyclic group.

9. A silver halide photographic material as claimed in claim 8, wherein said light-sensitive emulsion layer containing said silver halide emulsion further comprises at least one mercaptoheterocyclic compound represented by formula (a), (b) or (c):

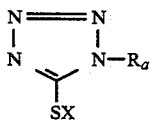

(a)

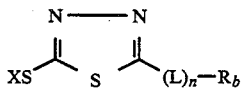

(b)

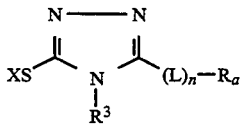

(c)

wherein $R_a$ represents an alkyl, alkenyl, or aryl group; X represents a hydrogen atom, an alkali metal atom, an ammonium group or a precursor thereof; $R_b$ represents a hydrogen atom or $R_a$; L represents a divalent linking group; n represents an integer 0 or 1; $R^3$ has the same meaning as $R_a$; and $R^3$ and $R_a$ may be the same or different.

10. A silver halide photographic material as in claim 8, which comprises a compound represented by formula (II) in which $R^{21}$ and $R^{22}$ together form a heterocyclic ring.

11. A silver halide photographic material as claimed in claim 8, wherein said silver bromochloride emulsion comprises an iridium compound.

* * * * *